US011976518B2

(12) United States Patent
Nakamura et al.

(10) Patent No.: US 11,976,518 B2
(45) Date of Patent: May 7, 2024

(54) DRILLING TIP AND DRILLING TOOL

(71) Applicant: MMC RYOTEC CORPORATION, Anpachi-gun (JP)

(72) Inventors: Kazuyoshi Nakamura, Anpachi-gun (JP); Hiroki Takatsuki, Anpachi-gun (JP)

(73) Assignee: MMC RYOTEC CORPORATION, Anpachi-gun (JP)

( * ) Notice: Subject to any disclaimer, the term of this patent is extended or adjusted under 35 U.S.C. 154(b) by 174 days.

(21) Appl. No.: 17/631,910

(22) PCT Filed: Jan. 17, 2020

(86) PCT No.: PCT/JP2020/001422
§ 371 (c)(1),
(2) Date: Feb. 1, 2022

(87) PCT Pub. No.: WO2021/024512
PCT Pub. Date: Feb. 11, 2021

(65) Prior Publication Data

US 2022/0290502 A1 Sep. 15, 2022

(30) Foreign Application Priority Data

Aug. 7, 2019 (JP) ..... 2019-145480

(51) Int. Cl.
*E21B 10/56* (2006.01)
*E21B 10/43* (2006.01)

(52) U.S. Cl.
CPC ..... *E21B 10/56* (2013.01); *E21B 10/43* (2013.01)

(58) Field of Classification Search
CPC .. E21B 10/5676; E21B 10/58; E21B 10/5671; E21B 10/5673
See application file for complete search history.

(56) References Cited

U.S. PATENT DOCUMENTS 4,679,639 A 7/1987 Barr et al.
4,997,049 A * 3/1991 Tank ..... B23B 27/141 407/119

(Continued)

FOREIGN PATENT DOCUMENTS

JP S60-199190 A 10/1985
JP H06-212874 A 8/1994

(Continued)

OTHER PUBLICATIONS

International Search Report dated Mar. 17, 2020, issued for PCT/JP2020/001422 and English translation thereof.

(Continued)

*Primary Examiner* — Kenneth L Thompson
(74) *Attorney, Agent, or Firm* — Locke Lord LLP

(57) ABSTRACT

A drilling tip that is attached to a distal end surface of a tool main body of a drilling tool which is rotated around an axis and in which a striking force is applied to a distal end side in a direction of the axis. The drilling tip includes a tip main body in which a base end portion having a columnar shape and a distal end portion protruding from this base end portion to the distal end side are integrally formed. The distal end portion includes a curved convex surface-shaped portion protruding to the distal end side of the tip main body, and a projection portion protruding to the distal end side from a surface of the curved convex surface-shaped portion.

14 Claims, 20 Drawing Sheets

(56) References Cited

U.S. PATENT DOCUMENTS

| | | | | |
|---|---|---|---|---|
| 5,154,245 | A | 10/1992 | Waldenstrom et al. | |
| 6,148,938 | A * | 11/2000 | Beaton | E21B 10/5673 175/428 |
| 7,631,709 | B2 * | 12/2009 | McDonough | E21B 10/16 175/398 |
| 11,598,153 | B2 * | 3/2023 | Graham | E21B 10/5673 |
| 2004/0112650 | A1 * | 6/2004 | Moseley | E21B 10/5673 175/426 |
| 2014/0182947 | A1 | 7/2014 | Bhatia et al. | |
| 2015/0129310 | A1 | 5/2015 | Newman | |
| 2015/0285005 | A1 * | 10/2015 | Shamburger | E21B 10/5673 175/57 |
| 2017/0362899 | A1 | 12/2017 | Belnap et al. | |
| 2018/0274303 | A1 * | 9/2018 | Song | C04B 41/53 |

FOREIGN PATENT DOCUMENTS

| | | | |
|---|---|---|---|
| JP | H07-293173 | A | 11/1995 |
| JP | 2012-057310 | A | 3/2012 |

OTHER PUBLICATIONS

Supplemental Euroepan Search Report dated Jun. 28, 2023, issued for European Patent Application No. 20850786.3.

* cited by examiner

DRILLING TIP AND DRILLING TOOL

TECHNICAL FIELD

The present invention relates to a drilling tip that is attached to a distal end surface of a tool main body of a drilling tool which is rotated around an axis and in which a striking force is applied to a distal end side in a direction of the axis and a drilling tool in which such a drilling tool is attached to the distal end surface of the tool main body.

Priority is claimed on Japanese Patent Application No. 2019-145480, filed Aug. 7, 2019, the content of which is incorporated herein by reference.

BACKGROUND ART

A drilling tool is rotated around an axis and used for the purpose of performing boring by applying a striking energy output from a rock drilling device such as a top hammer or a down-the-hole hammer to a tool main body rotating around the axis. In a drilling tool, a hard drilling tip (button bit) such as a button bit is attached to a distal end surface of a tool main body, and boring is performed by bringing a distal end portion of this drilling tip into contact with bedrock and propagating a striking energy thereto.

Regarding such drilling tips attached to a distal end surface of a tool main body of a drilling tool, a button tip having a hemispherical distal end portion of a tip main body, a ballistic tip having an artillery shell-type distal end portion, a spike tip having a shape of a rounded conical projection end as a distal end portion, and the like are known. A drilling tip having a shape optimal for the lithologic characteristics is selected. However, when wear of the distal end portion of the tip main body due to drilling is significant, a button tip is generally selected.

In such a drilling tip, the distal end portion of the tip main body becomes worn in accordance with the progress of boring so that the boring efficiency deteriorates and the service life thereof ends. In addition, a drilling tip having a worn distal end portion of the tip main body is also reused by repolishing the distal end portion and reproducing the shape of a blade edge. However, particularly, when a drilling tip (gauge tip) attached to a gauge surface in the outermost circumference on a distal end surface of a tool main body becomes worn, the boring diameter becomes small. Therefore, when the drilling tip reaches a certain size, the service life thereof also ends. For this reason, in order to maintain the boring efficiency over a long period of time, there is a need for a distal end portion of a tip main body to have a shape that is unlikely to become worn.

Hence, for example, Patent Document 1 describes a drilling tip in which a blade body (tip main body) of a super hard tip (drilling tip) is constituted of a columnar attachment portion buried in a base metal (tool main body) and a perforation portion formed at an upper end portion of this attachment portion. This perforation portion is formed to have a shape in which the radius of curvature sequentially decreases toward a distal end side and a plurality of hemispheres having radii of at least 1 mm or longer are stacked.

In addition, similarly, for the purpose of maintaining the boring efficiency over a long period of time, Patent Document 2 also describes a drilling tip in which curved convex surface portions in at least two stages having curved convex shapes of which the radii of curvature decrease in stages as a cross section along a tip center line goes toward a distal end side are formed at a distal end portion of the gauge tip.

CITATION LIST

Patent Literature

[Patent Document 1]

Japanese Unexamined Patent Application, First Publication No. H7-293173

[Patent Document 2]

Japanese Unexamined Patent Application, First Publication No. 2012-057310

SUMMARY OF INVENTION

Technical Problem

Incidentally, wear of such a drilling tip becomes prominent at the furthest protruding apex portion on a distal end side of a tool main body which comes into strong contact with bedrock in a distal end portion of a tip main body (an intersection part between a center line of a columnar base end portion of a tip main body and a distal end surface). Further, wear thereof spreads in a belt shape in a diameter direction with respect to the center line viewed from the distal end side of the tip main body at a part extending in a radial direction with respect to an axis of the tool main body from this apex portion. Particularly, in the gauge tip described above, a rolling distance according to boring rotation of the tool main body is long, and there are many parts which wear due to contact with a boring wall surface. Therefore, such belt-shaped wear becomes more prominent.

The present invention has been made based on such a background, and an object thereof is to provide a drilling tip and a drilling tool, in which deterioration in boring efficiency can be curbed and costs of repolishing can be reduced by curbing wear-width progression of a distal end portion of a tip main body of the drilling tip described above.

Solution to Problem

In order to resolve the foregoing problems and achieve such an object, a drilling tip of the present invention is a drilling tip that is attached to a distal end surface of a tool main body of a drilling tool which is rotated around an axis and in which a striking force is applied to a distal end side in a direction of the axis. The drilling tip includes a tip main body in which a base end portion having a columnar shape and a distal end portion protruding from this base end portion to the distal end side of the tip main body are integrally formed. The distal end portion includes a curved convex surface-shaped portion protruding to the distal end side of the tip main body, and a projection portion extending in a diameter direction with respect to a center line of the base end portion viewed from the distal end side of the tip main body and further protruding to the distal end side from a surface of the curved convex surface-shaped portion.

In addition, the present invention provides a drilling tool in which the foregoing drilling tip is attached to a distal end surface of a tool main body which is rotated around an axis and in which a striking force is applied to a distal end side in a direction of the axis such that the distal end portion protrudes and the projection portion extends in a radial direction with respect to the axis when viewed from the distal end side of the tool main body.

In the drilling tip having such a constitution, the distal end portion of the tip main body includes the curved convex surface-shaped portion protruding to the distal end side of the tip main body, and the projection portion extending in the diameter direction with respect to the center line viewed from the distal end side of the tip main body and further protruding to the distal end side from the surface of the curved convex surface-shaped portion. This drilling tip is attached such that the projection portion extends in the radial direction with respect to the axis when viewed from the distal end side of the tool main body as in the drilling tool having the foregoing constitution. Therefore, wear of this distal end portion of the tip main body progressing in a belt shape in the radial direction with respect to the axis can be limited to the projection portion.

Therefore, the service life of the tip main body can last until this projection portion wears down, and deterioration in boring efficiency of the drilling tool can be curbed. Moreover, even when this projection portion becomes worn and repolishing is performed, the projection portion need only be repolished instead of repolishing the entire distal end portion of the tip main body in a drilling tip having the foregoing constitution. Thus, costs incurred for repolishing can be reduced, and efficient and economical boring can be performed.

In addition, the projection portion is formed such that a protrusion height of the projection portion from the curved convex surface-shaped portion gradually increases toward a central portion positioned on the center line from both end portions of the tip main body in the diameter direction with respect to the center line. Therefore, it is possible to secure a longer boring length until the projection portion wears down in the central portion of the projection portion positioned on the center line where wear becomes most prominent.

Moreover, the projection portion is formed such that a largest width of the projection portion in a direction perpendicular to the diameter direction when viewed from the distal end side of the tip main body gradually increases toward the central portion positioned on the center line from both end portions in the diameter direction. Therefore, strength for the projection portion in this central portion can also be secured, and even when repolishing of the central portion is performed after the central portion of this projection portion has become worn, it is possible to secure a significant repolishing margin.

Furthermore, the projection portion is formed such that a width of the projection portion in a direction perpendicular to the diameter direction gradually increases toward the base end portion side. Therefore, it is possible to secure strength for the projection portion, and it is possible to secure a significant repolishing margin.

In order to form the projection portion such that the width of the projection portion in a direction perpendicular to the diameter direction gradually increases toward the base end portion side in this manner, the projection portion may be formed to protrude in an isosceles trapezoidal shape when viewed in the diameter direction and may be formed to protrude in a curved convex shape such as a convex arc when viewed in the diameter direction.

Moreover, both end portions of the projection portion in the diameter direction are formed to be positioned in a boundary portion between the base end portion and the distal end portion of the tip main body. Therefore, the projection portion is formed in the entire area of the distal end portion in the diameter direction. Thus, wear of the distal end portion can be more reliably curbed.

It is desirable that the largest width of the projection portion in a direction perpendicular to the diameter direction when viewed from the distal end side of the tip main body in a direction of the center line be within a range of ⅓ to ½ a diameter of the base end portion. When this width falls below ⅓ the diameter of the base end portion, there is concern that wear of the distal end portion may not be able to be reliably curbed. Meanwhile, when it exceeds ½, there is concern that increase in resistance may be caused.

In addition, the curved convex surface-shaped portion has a hemispherical shape centering on the center line as in a button tip. Therefore, even if the projection portion wears down, wear of the distal end portion of the tip main body can be curbed to a certain degree. It is desirable that the protrusion height of the projection portion from the curved convex surface-shaped portion on the center line be within a range of 0.13×D to 0.30×D with respect to a diameter D of the base end portion. If this protrusion height falls below 0.13×D with respect to the diameter D of the base end portion, there is concern that wear of the distal end portion may not be able to be reliably curbed. Meanwhile, if the protrusion height exceeds 0.30×D with respect to the diameter D of the base end portion, there is concern that breakage may occur in the projection portion.

Moreover, the projection portion may be formed of a polycrystalline diamond sintered body. In a drilling tip having the foregoing constitution as described above, wear of the distal end portion of the tip main body is limited to the projection portion. Thus, this projection portion is formed of a polycrystalline diamond sintered body having a higher hardness than a hard metal alloy used as a material of an ordinary tip main body. Therefore, wear of the tip main body can be further curbed, the service life of the projection portion can be extended, and deterioration in boring efficiency of the drilling tool can be more reliably curbed. In addition, it is also economical compared to when the entire distal end portion of the tip main body formed of a hard metal alloy is coated with a polycrystalline diamond sintered body as in a drilling tip using a general polycrystalline diamond sintered body.

Furthermore, when the projection portion is formed of a polycrystalline diamond sintered body in this manner, a concave groove may be formed in the diameter direction in the curved protrusion surface-shaped portion. The polycrystalline diamond sintered body may be arranged in the concave groove and the projection portion. Accordingly, interfacial adhesion strength between the polycrystalline diamond sintered body and the distal end portion of the tip main body is improved. Thus, a situation in which the projection portion formed of a polycrystalline diamond sintered body peels from the tip main body can be prevented.

Meanwhile, in the drilling tool having the foregoing constitution, when the distal end surface of the tool main body includes a face surface facing the distal end side of the tool main body at a central portion around the axis, and an outer circumference of this face surface includes a gauge surface extending to a rear end side toward an outer circumferential side of the tool main body, the drilling tip may be attached to both the face surface and the gauge surface. However, wear becomes prominent at a drilling tip (gauge tip) attached to a gauge surface as described above. Thus, the drilling tip may be attached to only the gauge surface thereof, and the drilling tip on the face surface may be a button tip or the like.

Advantageous Effects of Invention

As described above, according to the present invention, wear-width progression of the distal end portion of the tip main body of the drilling tip can be curbed, and deterioration in boring efficiency of the drilling tool can be curbed. In addition, even when repolishing is performed, the projection portion need only be repolished. Thus, costs incurred for repolishing can be reduced, and efficient and economical boring can be performed.

DESCRIPTION OF EMBODIMENTS

Figure 3:
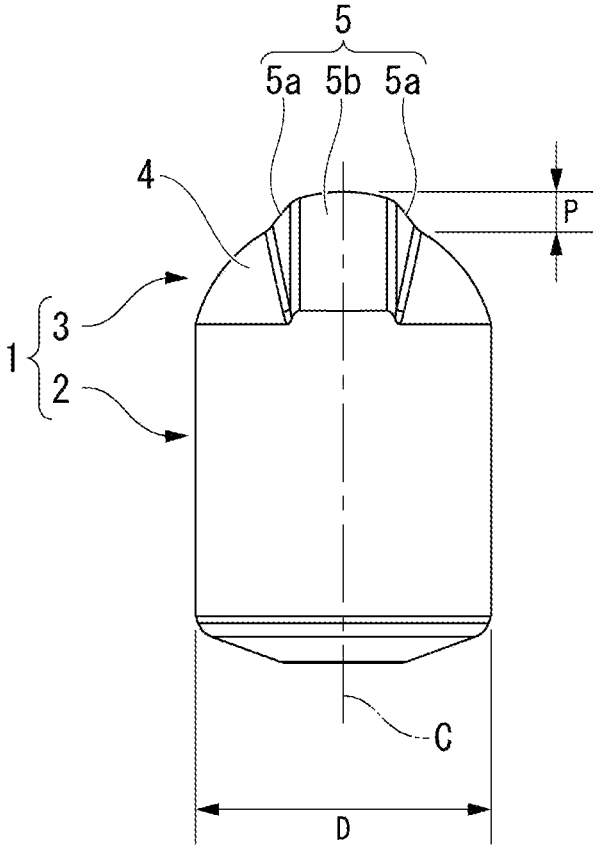
FIG. 3 is a side view viewed in an arrow X direction in FIG. 2.
Figure 4:
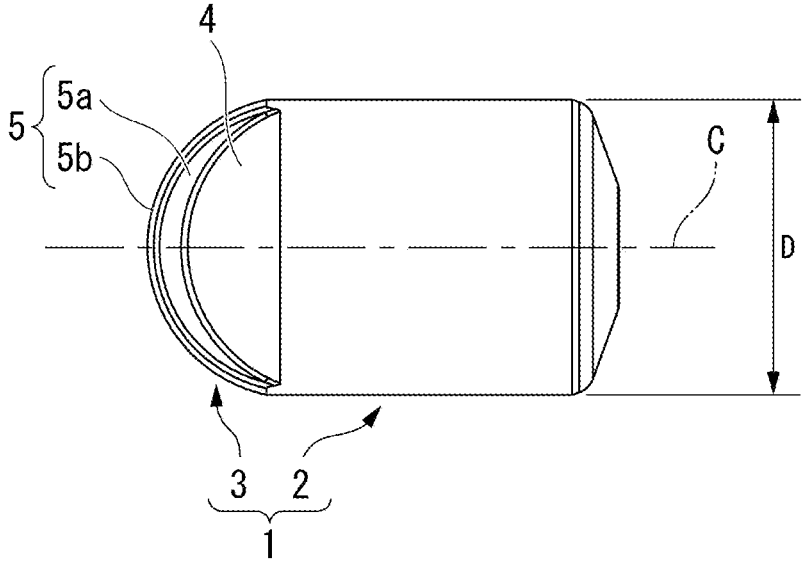
FIG. 4 is a side view viewed in an arrow Y direction in FIG. 2.
Figure 5:
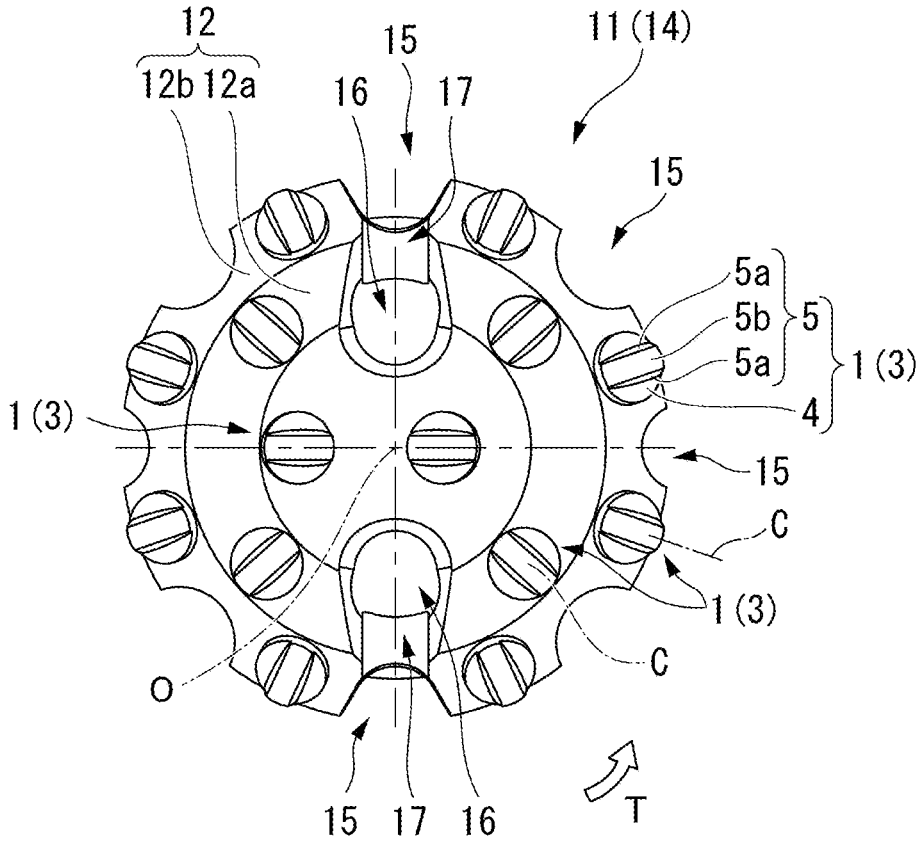
FIG. 5 is a front view of a first embodiment of a drilling tool of the present invention to which the drilling tip of the first embodiment illustrated in FIGS. 1 to 4 is attached.
Figure 6:
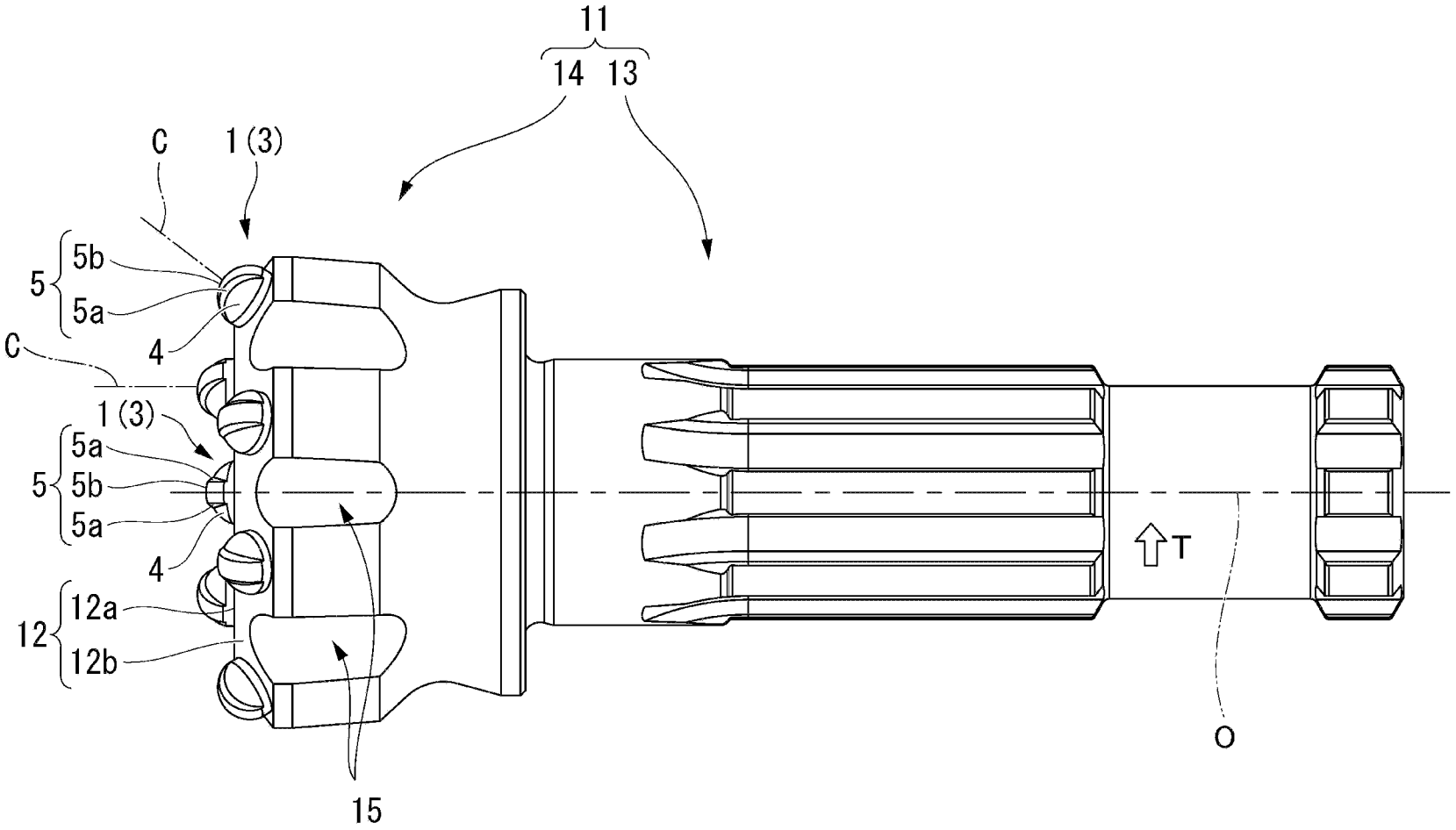
FIG. 6 is a side view of the first embodiment of the drilling tool of the present invention illustrated in FIG. 5.

FIGS. 1 to 4 illustrate a first embodiment of a drilling tip of the present invention, and FIGS. 5 and 6 illustrate a first embodiment of a drilling tool of the present invention to which the drilling tip of this first embodiment is attached. In the drilling tip of the present embodiment, a tip main body 1 is constituted using a hard material such as a hard metal alloy, in which a base end portion 2 having a columnar shape centering on a center line C and a distal end portion 3 protruding to a distal end side of the tip main body 1 (the upper side in FIG. 3 and the left side in FIG. 4) from this base end portion 2 are integrally formed. A rear end surface of the base end portion 2 is formed to have a truncated cone shape decreasing in diameter toward a rear end side of the tip main body 1.

Furthermore, the distal end portion 3 of the tip main body 1 includes a curved convex surface-shaped portion 4 protruding to the distal end side of the tip main body 1, and a projection portion 5 extending in a straight line shape in a diameter direction (a vertical direction in FIG. 2) with respect to the center line C of the base end portion 2 when viewed from the distal end side of the tip main body 1 and further protruding to the distal end side from a surface of the curved convex surface-shaped portion 4. The curved convex surface-shaped portion 4 is formed to have a hemispherical shape centering on the center line C.

This projection portion 5 is formed such that a protrusion height from the curved convex surface-shaped portion 4 gradually increases as illustrated in FIG. 4 toward a central portion positioned on the center line C from both end portions in the diameter direction. In addition, as illustrated in FIG. 3, this projection portion 5 is formed such that a width of the projection portion 5 in a direction perpendicular to the diameter direction (a lateral direction in FIGS. 2 and 3) gradually increases toward the base end portion 2 side of the tip main body 1.

Here, in the present embodiment, as illustrated in FIG. 3, this projection portion 5 includes two inclined surfaces 5*a* inclined such that they become closer to each other toward the distal end side from the curved convex surface-shaped portion 4, and an apex surface 5*b* facing the distal end side of the tip main body 1 connecting apex portions of these two inclined surfaces 5*a* to each other. The projection portion 5 is formed to protrude in an isosceles trapezoidal shape as illustrated in FIG. 3 when viewed in the diameter direction. As illustrated in FIG. 3 when viewed in the diameter direction, the inclined surfaces 5*a* have curved convex surface shapes slightly swelling in a direction perpendicular to this diameter direction.

Furthermore, the apex surface 5*b* having this isosceles trapezoidal shape is formed to have a curved convex shape with a radius equivalent to a radius of the curved convex surface-shaped portion 4 when viewed in the diameter direction. However, the apex surface 5*b* may have a curved convex shape with the radius of the curved convex surface-shaped portion 4 when viewed in the diameter direction.

In addition, intersection ridge portions of the two inclined surfaces 5*a* and the apex surface 5*b* are chamfered through curved convex surfaces, and corner portions where the two inclined surfaces 5*a* and the curved convex surface-shaped portion 4 intersect form curved concave surfaces.

Figure 1:
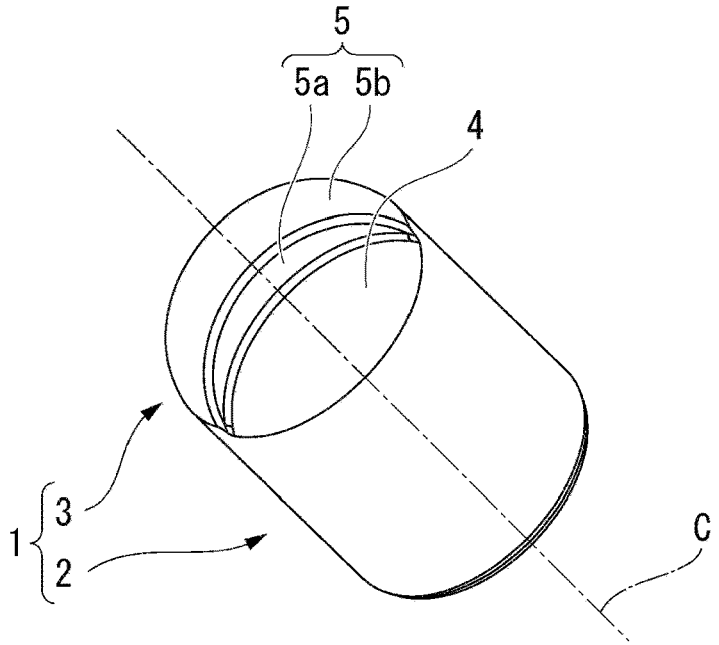
FIG. 1 is a perspective view illustrating a first embodiment of a drilling tip of the present invention viewed from a distal end side of a tip main body.

Moreover, this projection portion 5 is formed such that the largest width (the width of the tip main body 1 on the base end portion 2 side in the present embodiment) in a direction perpendicular to the diameter direction when viewed from the distal end side of the tip main body 1 as illustrated in FIG. 1 gradually increases toward the central portion positioned on the center line C from both end portions in the diameter direction.

Figure 2:
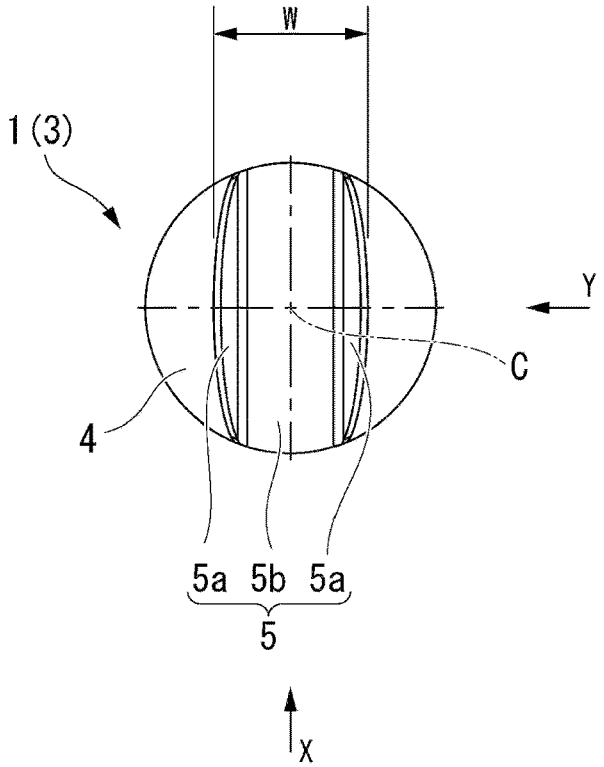
FIG. 2 is a front view of the first embodiment illustrated in FIG. 1 viewed from the distal end side of the tip main body.

In the present embodiment, the width of the apex surface 5*b* in a direction perpendicular to the diameter direction is substantially uniform, and as illustrated in FIG. 2, the inclined surfaces 5*a* have curved convex surface shapes slightly swelling toward the central portion positioned on the center line C from both end portions in the diameter direction are formed such that the largest width gradually increases.

Here, a largest width W of the projection portion 5 in a direction perpendicular to the diameter direction when viewed from the distal end side of the tip main body 1 in the direction of the center line C as illustrated in FIG. 2 is within a range of ⅓ to ½ a diameter D of the base end portion 2. Moreover, both end portions of this projection portion 5 in the diameter direction are positioned at a boundary portion between the base end portion 2 and the distal end portion 3 of the tip main body 1 as illustrated in FIGS. 3 and 4.

Such a drilling tip is attached to a distal end surface 12 of a tool main body 11 of the drilling tool illustrated in FIGS. 5 and 6 and used for boring bedrock or the like. The tool main body 11 is formed of a metal material such as a steel material to have a multi-stage columnar shape centering on an axis O. A rear end portion of the tool main body 11 (a part on the right side in FIG. 6) serves as a shank portion 13 attached to a down-the-hole hammer (not illustrated), and the distal end portion (a part on the left side in FIG. 6) serves as a head portion 14 having a larger diameter than the shank portion 13.

The distal end surface 12 of the head portion 14 of the tool main body 11 includes a face surface 12*a* facing the distal end side of the tool main body 11 at the central portion around the axis O, and an outer circumference of this face surface 12*a* includes a gauge surface 12*b* extending to the rear end side toward an outer circumferential side of the tool main body 11. The face surface 12*a* is a flat surface having a toric outer circumferential portion perpendicular to the axis O and having a mortar-shaped inner circumferential portion toward the rear end side of the tool main body 11 as it goes toward an inner circumferential side. In the present embodiment, the drilling tip of the foregoing embodiment is attached to both the face surface 12*a* and the gauge surface 12*b*.

A plurality of (eight in the present embodiment) cuttings discharge grooves 15 extending parallel to the axis O are formed on an outer circumferential surface of the head portion 14, and a plurality of (two in the present embodiment) blow holes 16 extending from the rear end surface of the shank portion 13 to the distal end side along the axis O and branching at the head portion 14 symmetrically open on the face surface 12*a* of the distal end surface 12 of the head portion 14 with respect to the axis O.

In addition, groove portions 17 communicating with the discharge grooves 15 positioned on a side opposite thereto with the axis O therebetween are formed through opening portions of these blow holes 16 from the face surface 12*a* to the gauge surface 12*b*.

On the distal end surface 12 of such a tool main body 11, in the drilling tip of the foregoing embodiment, the base end portion 2 having the center line C perpendicular to the face surface 12*a* and the gauge surface 12*b* is fitted into hole portions formed on the face surface 12*a* and the gauge surface 12*b* with circular cross sections by tight fitting such as shrink-fitting or press-fitting in a manner of avoiding the discharge grooves 15, the blow holes 16, and the groove portions 17. Accordingly, the distal end portion 3 is attached in a manner of protruding from the face surface 12*a* and the gauge surface 12*b*. At this time, the projection portion 5 of the distal end portion 3 of the tip main body 1 is attached such that it extends in a radial direction with respect to the axis O when viewed from the distal end side of the tool main body 11 as illustrated in FIG. 5.

The drilling tool having such a constitution performs boring by crushing bedrock using the drilling tip attached to the distal end surface 12 of the tool main body 11, which is rotated around the axis O in a tool rotation direction T by a rotation drive device coupled to the foregoing down-the-hole hammer via a drilling rod (not illustrated), and in which a striking force is applied to the distal end side in the direction of the axis O from this down-the-hole hammer.

Figure 7:
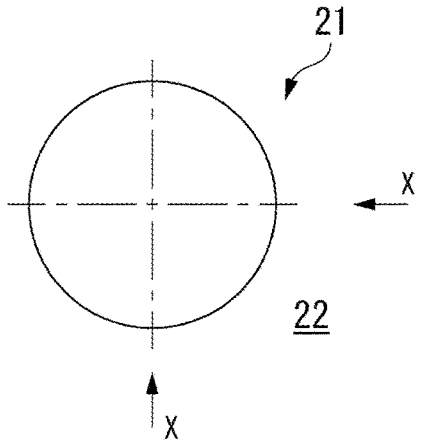
FIG. 7 is a front view of a general button tip viewed from the distal end side of the tip main body.
Figure 8:
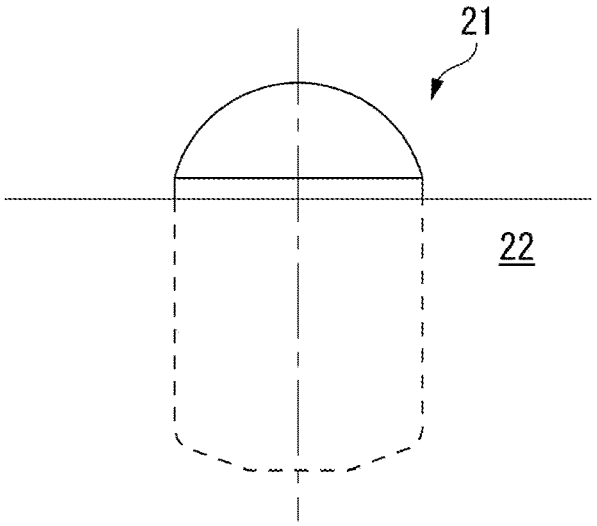
FIG. 8 is a side view viewed in the arrow X direction in FIG. 7.
Figure 9:
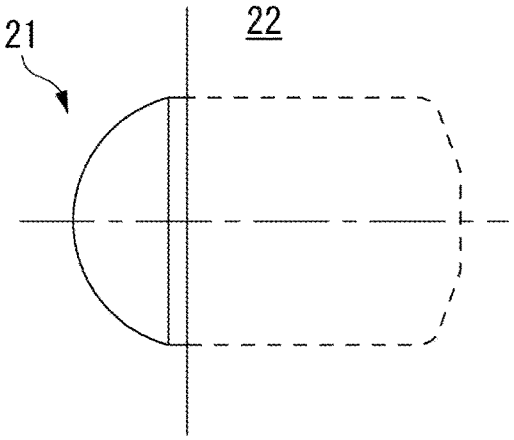
FIG. 9 is a side view viewed in the arrow Y direction in FIG. 7.
Figure 10:
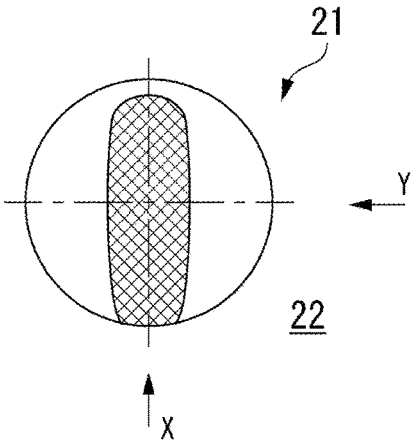
FIG. 10 is a front view illustrating a state of the wear of the button tip illustrated in FIG. 7 viewed from the distal end side of the tip main body.
Figure 11:
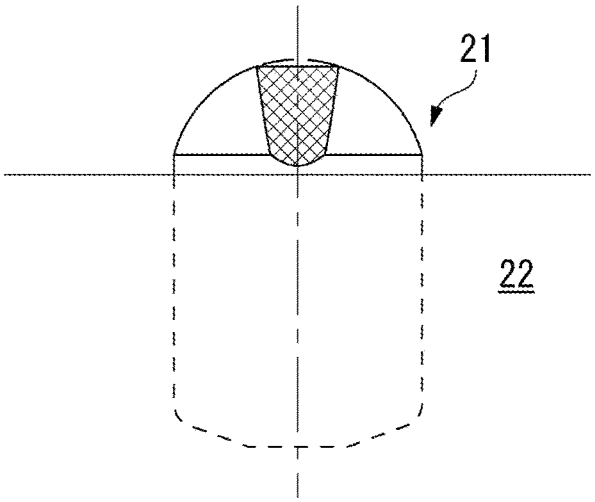
FIG. 11 is a side view viewed in the arrow X direction in FIG. 10.
Figure 12:
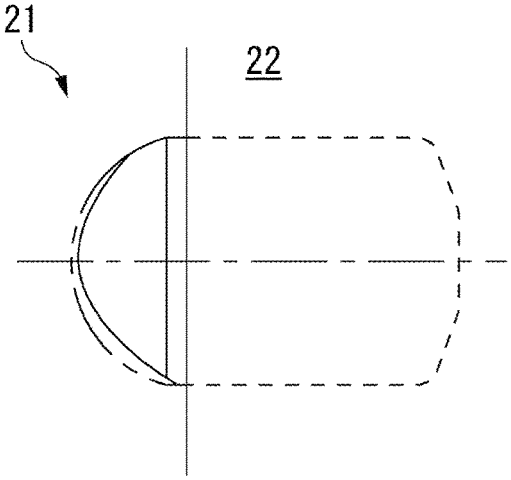
FIG. 12 is a side view viewed in the arrow Y direction in FIG. 10.

At this time, in a drilling tool in which a tip main body 21 of a general button tip illustrated in FIGS. 7 to 9 is attached to a tool main body 22, particularly on the gauge surface of the tool main body 22, belt-shaped wear (parts indicated by hatching in FIGS. 10 and 11) occurs at the distal end portion of the tip main body 21 in the diameter direction (vertical direction in FIGS. 10 and 12) with respect to the axis of the tool main body 22 as illustrated in FIGS. 10 to 12. Accordingly, the efficiency of boring bedrock using the drilling tip deteriorates.

Figure 13:
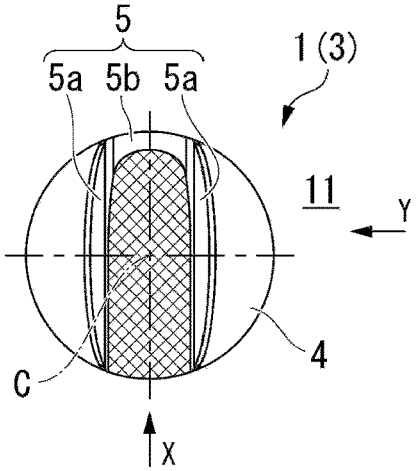
FIG. 13 is a front view illustrating a state of the wear of the drilling tip of the embodiment illustrated in FIG. 1 viewed from the distal end side of the tip main body.
Figure 14:
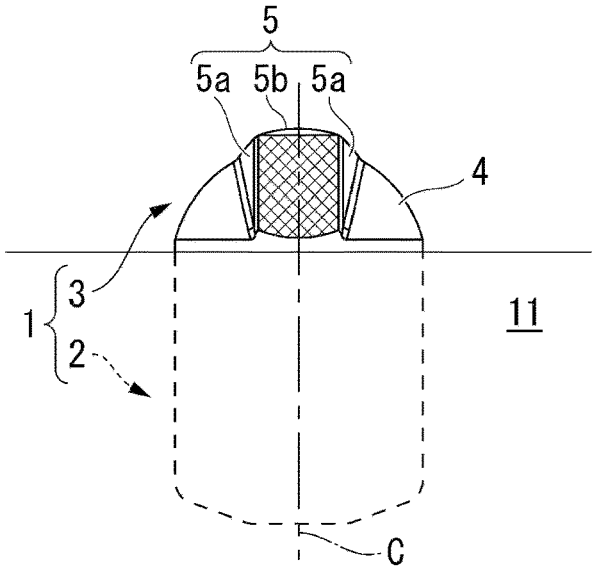
FIG. 14 is a side view viewed in the arrow X direction in FIG. 13.
Figure 15:
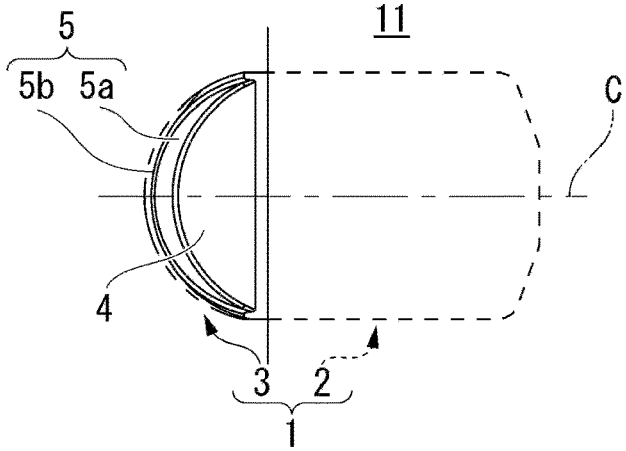
FIG. 15 is a side view viewed in the arrow Y direction in FIG. 13.

In contrast, in the drilling tip and the drilling tool having the foregoing constitution, as illustrated in FIGS. 13 to 15, although wear (parts indicated by hatching in FIGS. 13 and 14) similarly occurs at the distal end portion of the tip main body 21 in the diameter direction (vertical direction in FIGS. 13 and 15) with respect to the axis O of the tool main body 11, this wear of the distal end portion 3 of the tip main body 1 can be limited to the projection portion 5 as described above by attaching it such that the projection portion 5 extends in the radial direction with respect to the axis O of the tool main body 11.

For this reason, according to the drilling tip and the drilling tool having the foregoing constitution, until this projection portion 5 wears down, the service life of the tip main body 1 can be extended, and deterioration in boring efficiency of the drilling tool can be curbed. Particularly, in a drilling tip attached to the gauge surface 12*b* that is an outer circumferential portion of the distal end surface 12 of the tool main body 11, a rolling distance according to rotation of the tool main body 11 around the axis O is long, and there are many parts which wear due to contact with a boring wall surface. Therefore, such belt-shaped wear becomes more prominent. However, in a drilling tip attached to such a gauge surface 12*b*, the service life of the tip main body 1 can be extended.

Figure 16:
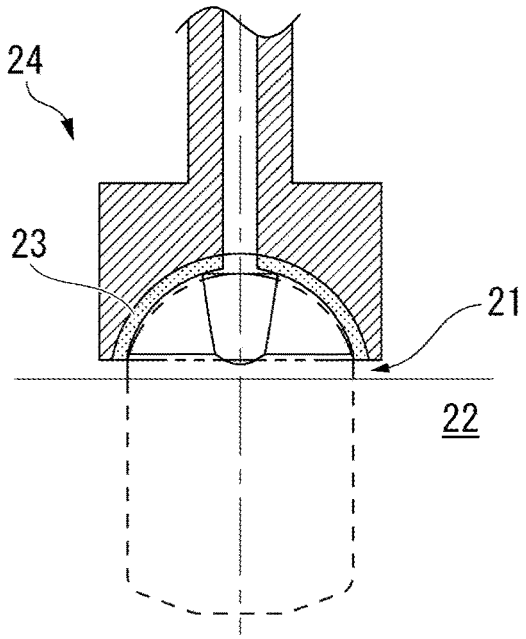
FIG. 16 is a cross-sectional view viewed in the arrow X direction in FIG. 10 when a worn drilling tip illustrated in FIG. 10 is repolished.

Moreover, in a general button tip illustrated in FIGS. 7 to 9, in order to repolish the tip main body 21 when belt-shaped wear occurs as illustrated in FIGS. 10 to 12, the entire hemispherical convex-shaped distal end portion of the tip main body 21 has to be repolished using a cup-shaped grinding stone 24 in which a diamond abrasive grain layer 23 having a spherical concave surface shape is formed on an inner circumferential surface of the distal end portion as illustrated in FIG. 16. For this reason, parts where wear is small in the distal end portion are also repolished, thereby causing increase in costs and time incurred for repolishing.

Figure 17:
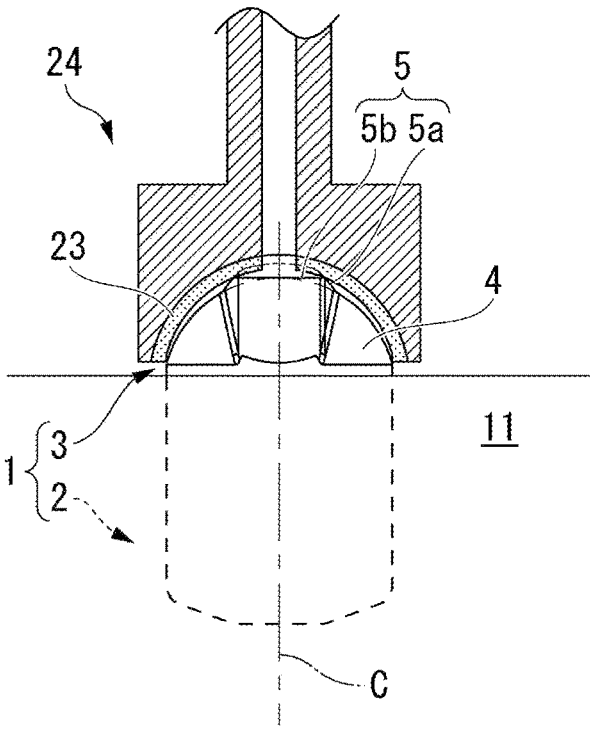
FIG. 17 is a cross-sectional view viewed in the arrow X direction in FIG. 13 when a worn drilling tip illustrated in FIG. 13 is repolished.
Figure 18:
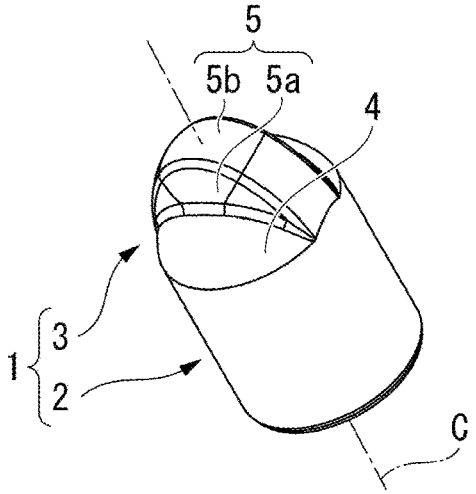
FIG. 18 is a perspective view illustrating a modification example of the first embodiment illustrated in FIGS. 1 to 4 viewed from the distal end side of the tip main body.

However, in contrast, in a drilling tip having the foregoing constitution, when wear occurs in the projection portion 5 as illustrated in FIG. 17, simply this projection portion 5 need only be repolished using the cup-shaped grinding stone 24 as described above, and there is no need to repolish the entire distal end portion 3. That is, there is no need to repolish the curved convex surface-shaped portion 4 other than the projection portion 5 of the distal end portion 3 where wear is small. Therefore, costs and time incurred for repolishing can be reduced and abrasion of the cup-shaped grinding stone 24 can be minimized so that efficient and economical boring can be performed.

In addition, in the present embodiment, this projection portion 5 is formed such that the protrusion height from the curved convex surface-shaped portion 4 gradually increases toward the central portion positioned on the center line C from both end portions in the diameter direction with respect to the center line C of the tip main body 1. For this reason, it is possible to secure a longer boring length until the projection portion 5 wears down in the central portion of the projection portion which protrudes to the distal end side of the tool main body 11 and is positioned on the center line C where wear becomes most prominent in the projection portion 5, and it is possible to perform more efficient and economical boring.

Moreover, in the present embodiment, the projection portion 5 is formed such that the largest width of the projection portion 5 in a direction perpendicular to the diameter direction when viewed from the distal end side of the tip main body 1 gradually increases toward the central portion positioned on the center line C from both end portions in the diameter direction. For this reason, strength for the projection portion 5 in this central portion can also be secured, and even when repolishing of the central portion is performed after the central portion of this projection portion 5 has become worn, it is possible to secure a significant repolishing margin, and the service life of the projection portion 5 can be extended.

Furthermore, in the present embodiment, the projection portion 5 is formed such that the width of the projection portion 5 in a direction perpendicular to the diameter direction gradually increases toward the base end portion 2 side of the tip main body 1. Therefore, it is possible to secure strength for the projection portion 5, and it is possible to secure a significant repolishing margin, which is more efficient and economical.

In addition, in order to form the projection portion 5 such that the width of the projection portion 5 in a direction perpendicular to the diameter direction gradually increases toward the base end portion 2 side in this manner, in the present embodiment as illustrated in FIG. 3, the projection portion 5 is formed to protrude in an isosceles trapezoidal shape when viewed in the diameter direction. For this reason, the pressure when the projection portion 5 comes into with contact bedrock can be dispersed, and wear of the projection portion 5 itself can be curbed.

Moreover, in the present embodiment, both end portions of such a projection portion 5 in the diameter direction are formed to be positioned in the boundary portion between the base end portion 2 and the distal end portion 3 of the tip main body 1 as illustrated in FIGS. 3 and 4. That is, the projection portion 5 is formed in the entire area of the distal end portion 3 in the diameter direction. Therefore, for example, compared to when this projection portion 5 is formed to partially protrude in the curved convex surface-shaped portion 4 of the distal end portion 3 or the like, wear of the distal end portion 3 of the tip main body 1 can be more reliably curbed.

Furthermore, in the present embodiment, the largest width W of the projection portion 5 in a direction perpendicular to the diameter direction when viewed from the distal end side of the tip main body 1 in the direction of the center line C is within a range of ⅓ to ½ the diameter D of the base end portion 2. Here, when this width W falls below ⅓ the diameter D of the base end portion 2, the width of the apex surface 5*b* of the projection portion 5 is also reduced, and thus there is concern that wear of the distal end portion 3 may not be able to be reliably curbed. Meanwhile, when this width W exceeds ½ the diameter D of the base end portion 2, the width of the apex surface 5*b* also becomes excessively large, and thus there is concern that increase in resistance due to contact with bedrock may be caused.

In addition, in the present embodiment, the curved convex surface-shaped portion 4 of the distal end portion 3 of the tip main body 1 is formed to have a hemispherical shape centering on the center line C as in a button tip. For this reason, even if the projection portion 5 wears down due to long-term boring, the drilling tip can be used as in an ordinary button tip, and boring can be performed while wear of the distal end portion 3 of the tip main body 1 can be curbed to a certain degree.

As illustrated in FIG. 3, it is desirable that a protrusion height P of the projection portion 5 from the curved convex surface-shaped portion 4 on the center line C be within a range of 0.13×D to 0.30×D with respect to the diameter D of the base end portion 2. If this protrusion height P falls below 0.13×D with respect to the diameter D of the base end portion 2, the projection portion 5 becomes excessively short, and the projection portion 5 wears down due to the short boring length. Therefore, there is concern that the effects described above may not be able to achieved. In addition, if this protrusion height P exceeds 0.30×D with respect to the diameter D of the base end portion 2, the projection portion 5 excessively protrudes, and thus there is concern that the projection portion 5 may break due to resistance from bedrock at the time of boring.

Next, FIGS. 18 to 21 illustrate a modification example of the drilling tip of the first embodiment illustrated in FIGS. 1 to 4, and the same reference signs are applied to parts common to the first embodiment. Also in this modification example, the tip main body 1 is constituted using a hard material such as a hard metal alloy, in which the base end portion 2 having the columnar shape centering on the center line C and the distal end portion 3 protruding to the distal end side of the tip main body 1 (the upper side in FIG. 20 and the left side in FIG. 21) from this base end portion 2 are integrally formed, and the rear end surface of the base end portion 2 is formed to have a truncated cone shape decreasing in diameter toward the rear end side of the tip main body 1.

Furthermore, the distal end portion 3 of the tip main body 1 includes the curved convex surface-shaped portion 4 protruding to the distal end side of the tip main body 1, and the projection portion 5 extending in a straight line shape in the diameter direction (the vertical direction in FIGS. 19 and 21) with respect to the center line C of the base end portion 2 when viewed from the distal end side of the tip main body 1 and further protruding to the distal end side from the surface of the curved convex surface-shaped portion 4. In addition, similar to the first embodiment, the curved convex surface-shaped portion 4 is formed to have a hemispherical shape centering on the center line C.

Figure 20:
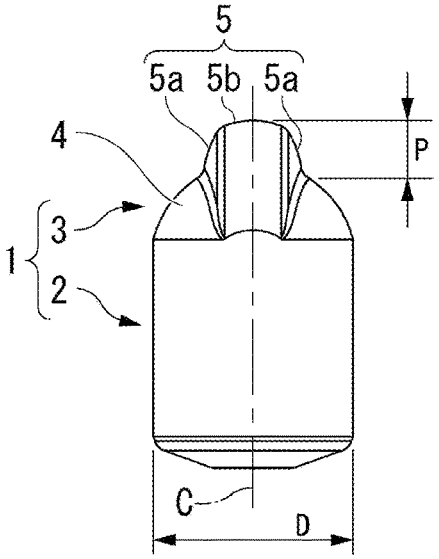
FIG. 20 is a side view viewed in the arrow X direction in FIG. 19.
Figure 21:
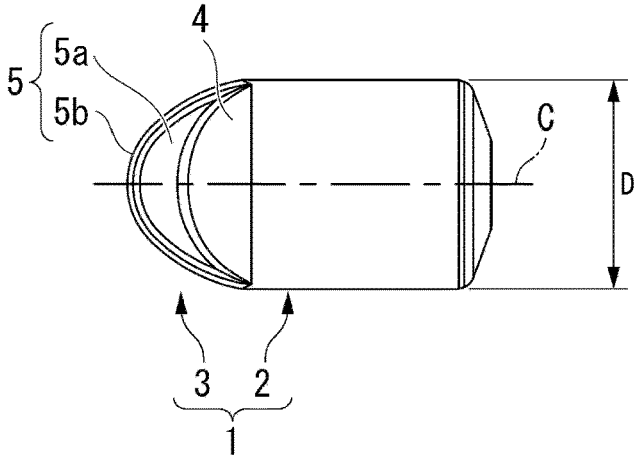
FIG. 21 is a side view viewed in the arrow Y direction in FIG. 19.
Figure 22:
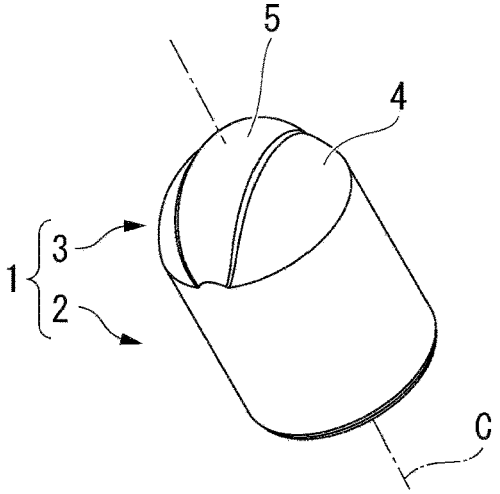
FIG. 22 is a perspective view illustrating a second embodiment of the drilling tip of the present invention viewed from the distal end side of the tip main body.

The projection portion 5 is formed such that the protrusion height from the curved convex surface-shaped portion 4 gradually increases as illustrated in FIG. 21 toward the central portion positioned on the center line C from both end portions in the diameter direction. In addition, as illustrated in FIG. 20, this projection portion 5 is formed such that the width of the projection portion 5 in a direction perpendicular to the diameter direction (the lateral direction in FIG. 20) gradually increases toward the base end portion 2 side of the tip main body 1.

In addition, similar to the first embodiment, as illustrated in FIG. 20, this projection portion 5 also includes two inclined surfaces 5*a* inclined such that they become closer to each other toward the distal end side from the curved convex surface-shaped portion 4, and the apex surface 5*b* facing the distal end side of the tip main body 1 connecting the apex portions of these two inclined surfaces 5*a* to each other. The projection portion 5 is formed to protrude in an isosceles trapezoidal shape as illustrated in FIG. 3 when viewed in the diameter direction. The intersection ridge portions of the two inclined surfaces 5*a* and the apex surface 5*b* are chamfered through curved convex surfaces, and corner portions where the two inclined surfaces 5*a* and the curved convex surface-shaped portion 4 intersect form curved concave surfaces.

Further, in this modification example, the protrusion height P of this projection portion 5 from the curved convex surface-shaped portion 4 on the center line C illustrated in FIG. 20 is larger than that of the first embodiment illustrated in FIGS. 1 to 4. The apex surface 5*b* having this isosceles trapezoidal shape also has a curved convex shape with a radius equivalent to the radius of the curved convex surface-shaped portion 4 when viewed in the diameter direction. However, it may have a curved convex shape with a different radius.

Figure 19:
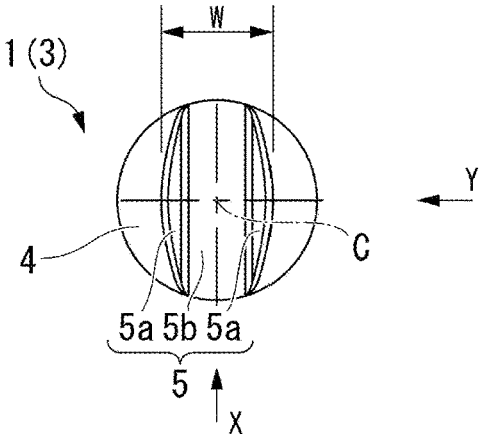
FIG. 19 is a front view of the modification example illustrated in FIG. 18 viewed from the distal end side of the tip main body.

Moreover, this projection portion 5 is formed such that the largest width (the width of the tip main body 1 on the base end portion 2 side in the present embodiment) in a direction perpendicular to the diameter direction when viewed from the distal end side of the tip main body 1 gradually increases toward the central portion positioned on the center line C from both end portions in the diameter direction as illustrated in FIG. 19.

In addition, the largest width W of the projection portion 5 in a direction perpendicular to the diameter direction when viewed from the distal end side of the tip main body 1 in the direction of the center line C as illustrated in FIG. 19 is within a range of ⅓ to ½ the diameter D of the base end portion 2. Moreover, both end portions of this projection portion 5 in the diameter direction are positioned at the boundary portion between the base end portion 2 and the distal end portion 3 of the tip main body 1 as illustrated in FIGS. 20 and 21.

Also in a drilling tip of such a modification example, the tip main body 1 is attached to the distal end surface 12 of the tool main body 11 such that the projection portion 5 extends in the radial direction with respect to the axis O of the tool main body 11 when viewed from the distal end side of the tool main body 11. Accordingly, similar to the first embodiment, the service life of the tip main body 1 can be extended, deterioration in boring efficiency of the drilling tool can be curbed, and costs and time incurred for repolishing can be reduced.

Moreover, in the drilling tip of this modification example, the protrusion height P of the projection portion 5 from the curved convex surface-shaped portion 4 on the center line C is large. Therefore, the boring length until this projection portion 5 wears down can be further increased, and thus more efficient and economical boring than the first embodiment can be performed. In this manner, including the case in which the protrusion height P of the projection portion 5 is increased, similar to the first embodiment, it is desirable that the protrusion height P of the projection portion 5 from the curved convex surface-shaped portion 4 on the center line C be within a range of 0.13×D to 0.30×D with respect to the diameter D of the base end portion 2.

In addition, FIGS. 22 to 25 illustrate a second embodiment of the drilling tip of the present invention, and the same reference signs are also applied to parts common to the first embodiment. Also in this second embodiment, the tip main body 1 is constituted using a hard material such as a hard metal alloy, in which the base end portion 2 having the columnar shape centering on the center line C and the distal end portion 3 protruding to the distal end side of the tip main body 1 (the upper side in FIG. 24 and the left side in FIG. 25) from this base end portion 2 are integrally formed. In addition, the rear end surface of the base end portion 2 is formed to have a truncated cone shape decreasing in diameter toward the rear end side of the tip main body 1.

Furthermore, the distal end portion 3 of the tip main body 1 includes the curved convex surface-shaped portion 4 protruding to the distal end side of the tip main body 1, and the projection portion 5 extending in a straight line shape in the diameter direction (the vertical direction in FIGS. 23 and 25) with respect to the center line C of the base end portion 2 when viewed from the distal end side of the tip main body 1 and further protruding to the distal end side from the surface of the curved convex surface-shaped portion 4. In addition, similar to the first embodiment, the curved convex surface-shaped portion 4 is formed to have a hemispherical shape centering on the center line C.

Figure 24:
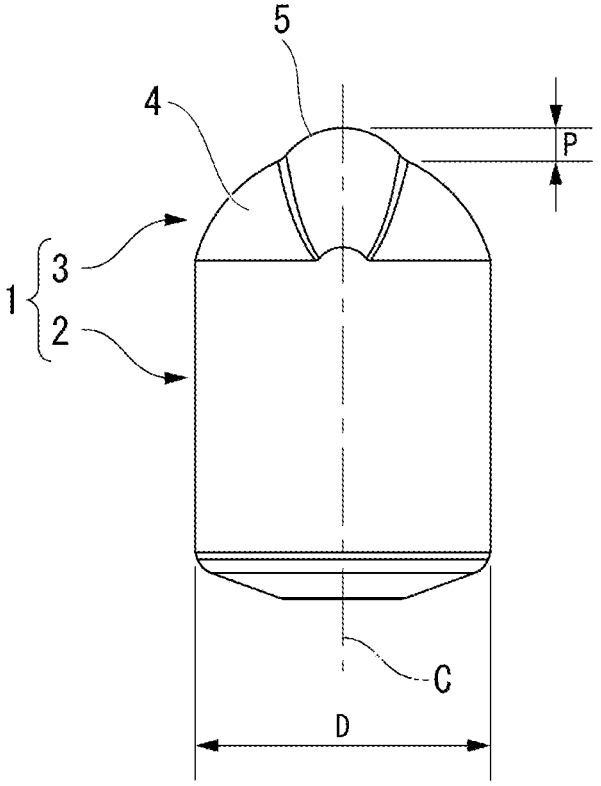
FIG. 24 is a side view viewed in the arrow X direction in FIG. 23.
Figure 25:
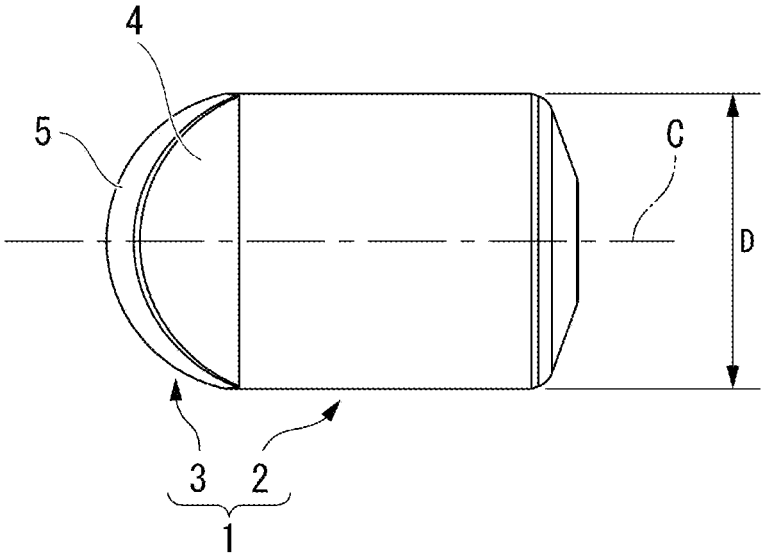
FIG. 25 is a side view viewed in the arrow Y direction in FIG. 24.

The projection portion 5 is formed such that the protrusion height from the curved convex surface-shaped portion 4 gradually increases as illustrated in FIG. 25 toward the central portion positioned on the center line C from both end portions in the diameter direction. In addition, as illustrated in FIG. 24, this projection portion 5 is formed such that the width of the projection portion 5 in a direction perpendicular to the diameter direction (the lateral direction in FIG. 24) gradually increases toward the base end portion 2 side of the tip main body 1.

Further, in this second embodiment, the projection portion 5 is formed to protrude in a curved convex shape such as a convex arc as illustrated in FIG. 24 when viewed in the diameter direction. The radius of curvature of this curved convex (the radius in the case of a convex arc) is set such that the protrusion height P of the projection portion 5 from the curved convex surface-shaped portion 4 on the center line C is within a range of 0.13×D to 0.30×D with respect to the diameter D of the base end portion 2 as described above.

Figure 23:
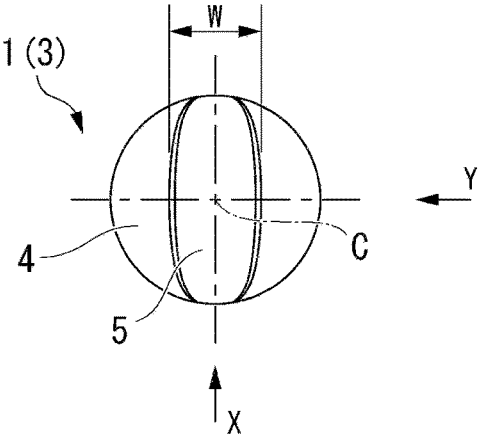
FIG. 23 is a front view of the second embodiment illustrated in FIG. 22 viewed from the distal end side of the tip main body.

Moreover, also in this second embodiment, the projection portion 5 is formed such that the largest width (the width of the tip main body 1 on the base end portion 2 side in the present embodiment) in a direction perpendicular to the diameter direction when viewed from the distal end side of the tip main body 1 as illustrated in FIG. 23 gradually increases toward the central portion positioned on the center line C from both end portions in the diameter direction.

In addition, the largest width W of the projection portion 5 in a direction perpendicular to the diameter direction when viewed from the distal end side of the tip main body 1 in the direction of the center line C as illustrated in FIG. 23 is within a range of ⅓ to ½ the diameter D of the base end portion 2. Moreover, both end portions of this projection portion 5 in the diameter direction are positioned at the boundary portion between the base end portion 2 and the distal end portion 3 of the tip main body 1 as illustrated in FIGS. 24 and 25.

Also in such a drilling tip of the second embodiment, the tip main body 1 is attached to the distal end surface 12 of the tool main body 11 such that the projection portion 5 extends in the radial direction with respect to the axis O of the tool main body 11 when viewed from the distal end side of the tool main body 11. Accordingly, similar to the first embodiment, the service life of the tip main body 1 can be extended, deterioration in boring efficiency of the drilling tool can be curbed, and costs and time incurred for repolishing can be reduced.

Moreover, in this second embodiment, the projection portion 5 protrudes in a curved convex shape such as a convex arc when viewed in the diameter direction. Therefore, compared to when the apex surface 5*b* of the projection portion 5 is formed to have a curved convex shape with a radius larger than the radius of the curved convex surface-shaped portion 4 when viewed in the diameter direction, the projection portion 5 can sharply enter bedrock. For this reason, higher boring efficiency can be achieved.

Figure 26:
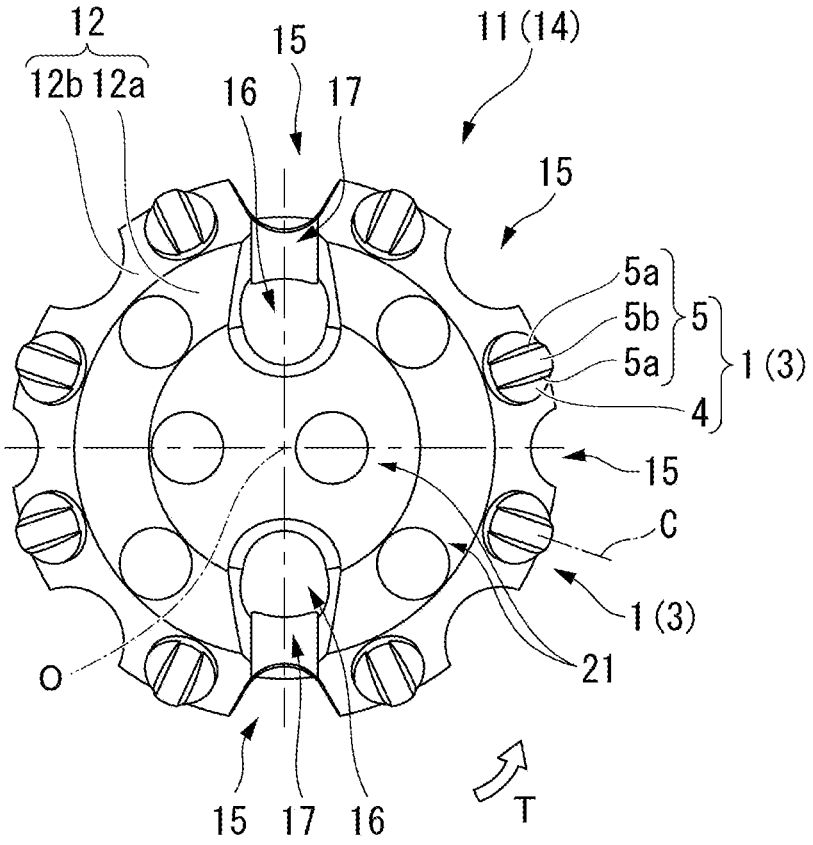
FIG. 26 is a front view of the second embodiment of the drilling tool of the present invention to which the drilling tip of the first embodiment illustrated in FIGS. 1 to 4 is attached.
Figure 27:
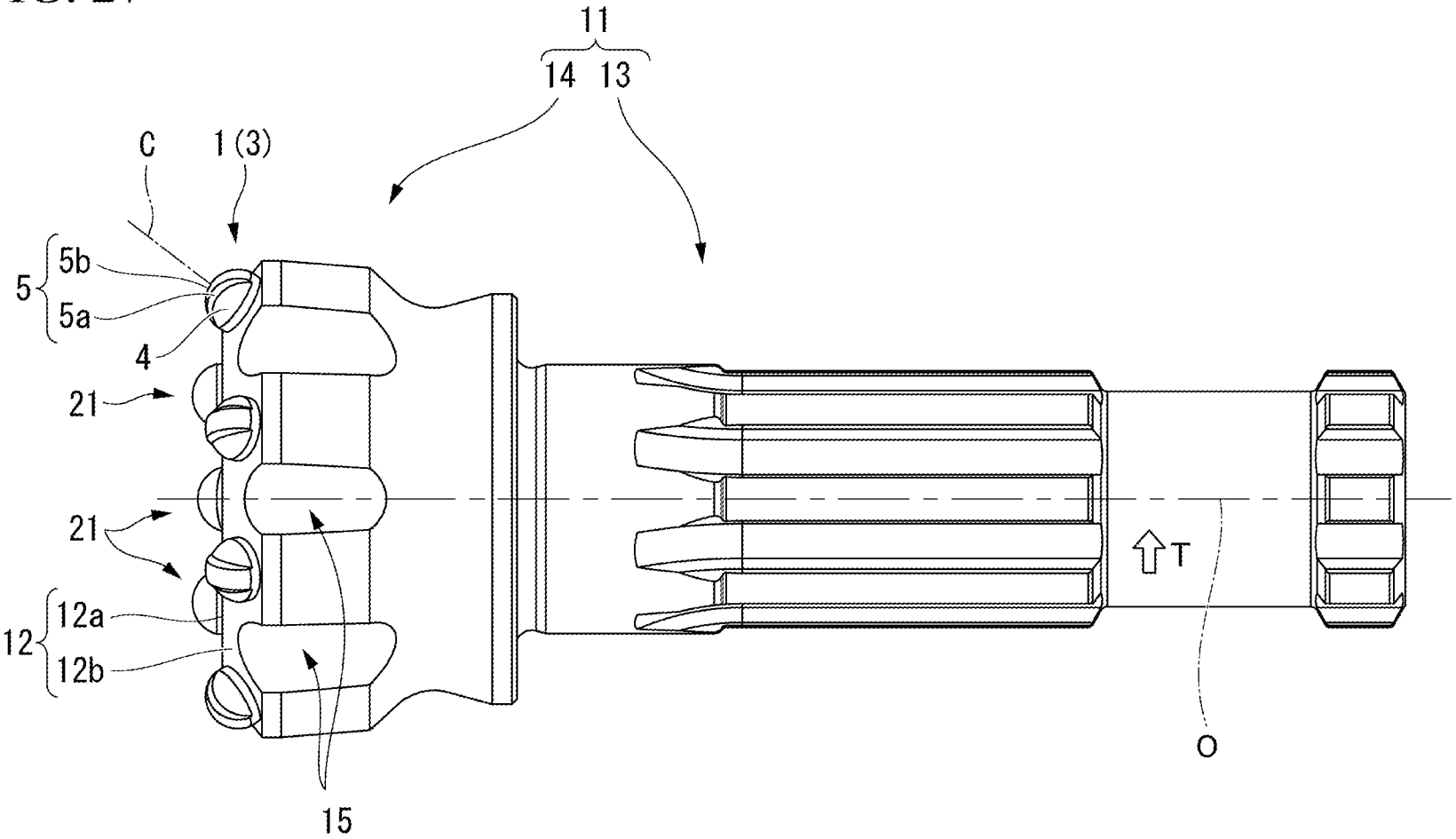
FIG. 27 is a side view of the second embodiment of the drilling tool of the present invention illustrated in FIG. 26.
Figure 28:
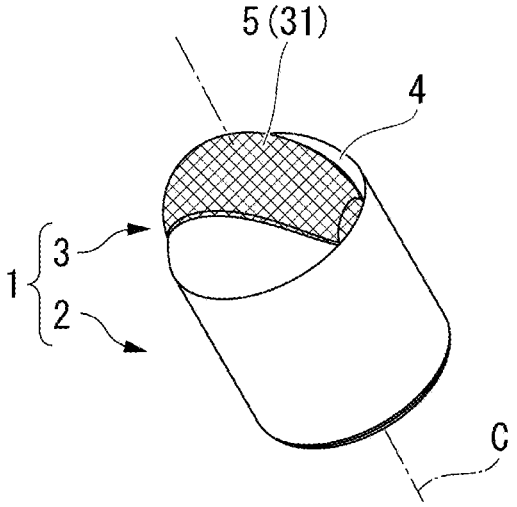
FIG. 28 is a perspective view illustrating a third embodiment of the drilling tip of the present invention viewed from the distal end side of the tip main body.
Figure 29:
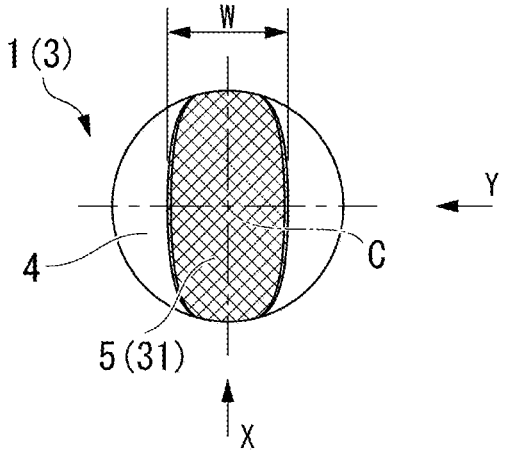
FIG. 29 is a front view of the third embodiment illustrated in FIG. 28 viewed from the distal end side of the tip main body.
Figure 30:
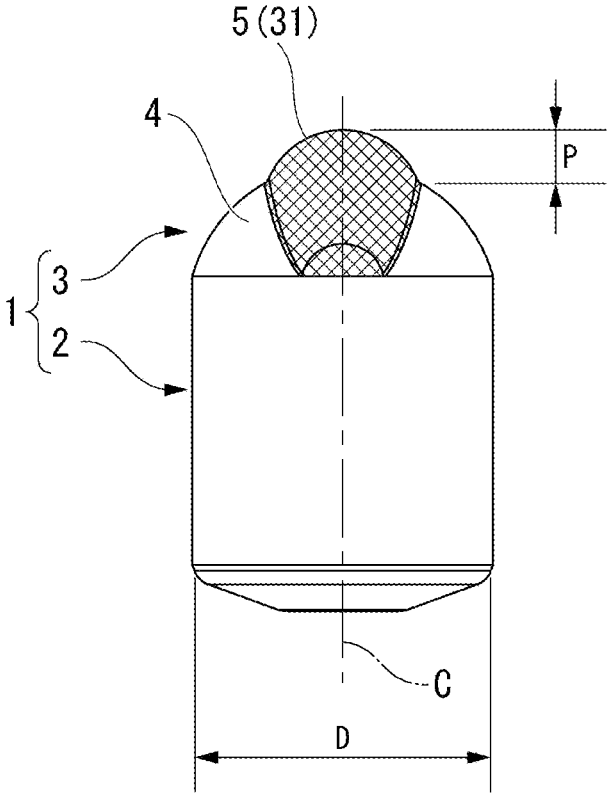
FIG. 30 is a side view viewed in the arrow X direction in FIG. 29.
Figure 31:
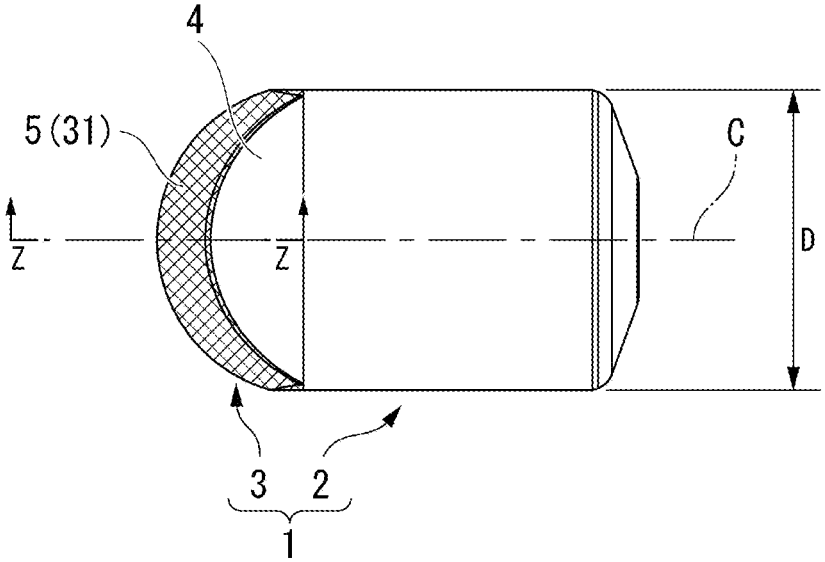
FIG. 31 is a side view viewed in the arrow Y direction in FIG. 29.

Furthermore, FIGS. 26 and 27 illustrate the second embodiment of the drilling tool of the present invention, and the same reference signs are applied to parts common to the drilling tool of the first embodiment illustrated in FIGS. 5 and 6. Also in the present embodiment, the tool main body 11 is formed of a metal material such as a steel material to have a multi-stage columnar shape centering on the axis O. The rear end portion of the tool main body 11 (a part on the right side in FIG. 27) serves as the shank portion 13 attached to a down-the-hole hammer (not illustrated), and the distal end portion (a part on the left side in FIG. 27) serves as the head portion 14 having a larger diameter than the shank portion 13.

On the distal end surface 12 of the head portion 14 of the tool main body 11, the face surface 12*a* facing the distal end side of the tool main body 11 is formed at the central portion around the axis O, and the gauge surface 12*b* extending to the rear end side toward the outer circumferential side of the tool main body 11 is formed in the outer circumference of this face surface 12*a*. The face surface 12*a* is configured to have a flat surface at a tone outer circumferential portion perpendicular to the axis O and a mortar-shaped inner circumferential portion toward the rear end side of the tool main body 11 as it goes toward the inner circumferential side.

In addition, a plurality of (also eight in the present embodiment) cuttings discharge grooves 15 extending parallel to the axis O are formed on the outer circumferential surface of the head portion 14. In addition, a plurality of (also two in the present embodiment) blow holes 16 extending from the rear end surface of the shank portion 13 to the distal end side along the axis O and branching at the head portion 14 symmetrically open on the face surface 12*a* of the distal end surface 12 of the head portion 14 with respect to the axis O. In addition, the groove portions 17 communicating with the discharge grooves 15 positioned on a side opposite to the axis O therebetween are formed through the opening portions of these blow holes 16 from the face surface 12*a* to the gauge surface 12*b*.

Also in the present embodiment, a drilling tip is attached to both the face surface 12*a* and the gauge surface 12*b*. However, in this second embodiment, in the drilling tip of the foregoing first embodiment, the base end portion 2 having the center line C perpendicular to the gauge surface 12*b* is fitted into the hole portions formed on only the gauge surface 12*b* on the distal end surface 12 of the tool main body 11 with circular cross sections by tight fitting in a manner of avoiding the discharge grooves 15 and the groove portions 17. Therefore, the distal end portion 3 is attached in a manner of protruding from the gauge surface 12*b*. At this time, the projection portion 5 of the distal end portion 3 of the tip main body 1 is attached such that it extends in the radial direction with respect to the axis O when viewed from the distal end side of the tool main body 11 as illustrated in FIG. 26.

In addition, in this second embodiment, in a tip main body 21 of the drilling tip such as a general button tip as illustrated in FIGS. 7 to 9 different from the drilling tip of the present invention, a base end portion having a columnar shape having the center line C perpendicular to the gauge surface 12*b* is fitted into the hole portions formed on the face surface 12*a* with circular cross sections by tight fitting in a manner of avoiding the blow holes 16 and the groove portions 17. Therefore, the distal end portion of the hemispherical shape is attached in a manner of protruding from the gauge surface 12*b*.

The drilling tool of the second embodiment having such a constitution also performs boring by crushing bedrock using the drilling tip attached to the distal end surface 12 of the tool main body 11, which is rotated around the axis O by a rotation drive device coupled to the foregoing down-the-hole hammer via a drilling rod (not illustrated), and in which a striking force is applied to the distal end side in the direction of the axis O from this down-the-hole hammer.

Here, in the drilling tip attached to the gauge surface 12*b* as described above, the rolling distance according to rotation of the tool main body 11 around the axis O is long, and there are many parts which wear due to contact with the boring wall surface. Therefore, wear becomes more prominent. In contrast, at a drilling tip attached to such a gauge surface 12*b* in the drilling tool of this second embodiment, the projection portion 5 is formed at the distal end portion of the tip main body 1 as in the first embodiment. Therefore, efficient and economical boring can also be performed.

On the other hand, since a drilling tip attached to the face surface 12*a* has a shorter rolling distance than the drilling tip attached to the gauge surface 12*b* and simply comes into contact with a boring bottom surface, wear is small. Therefore, according to the drilling tool of this second embodiment, the balance between the service lives of the drilling tip attached to the face surface 12*a* and the drilling tip attached to the gauge surface 12*b* can be achieved.

Next, FIGS. 28 to 32 illustrate a third embodiment of the drilling tip of the present invention, and FIGS. 33 to 37 illustrate a fourth embodiment of the drilling tip of the present invention. In addition, the same reference signs are also applied to parts common to the first embodiment. In the third and fourth embodiments, similar to the second embodiment, the projection portion 5 is formed to protrude in a curved convex shape such as a convex arc when viewed in the diameter direction.

Figure 32:
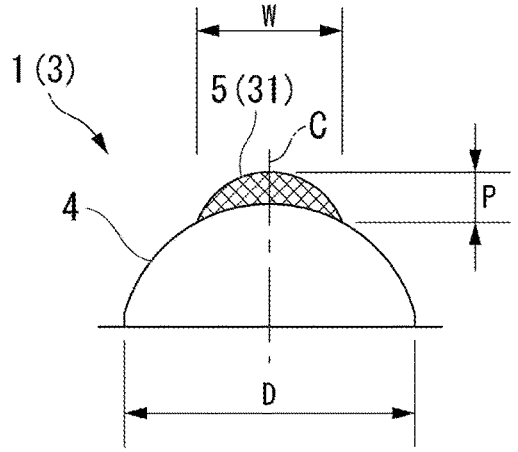
FIG. 32 is a ZZ cross-sectional view in FIG. 30.
Figure 33:
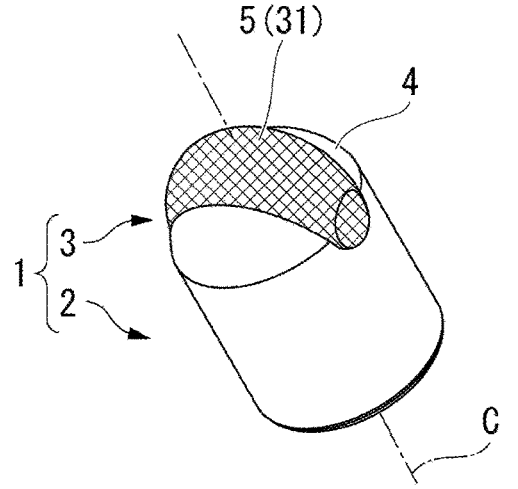
FIG. 33 is a perspective view illustrating a fourth embodiment of the drilling tip of the present invention viewed from the distal end side of the tip main body.
Figure 34:
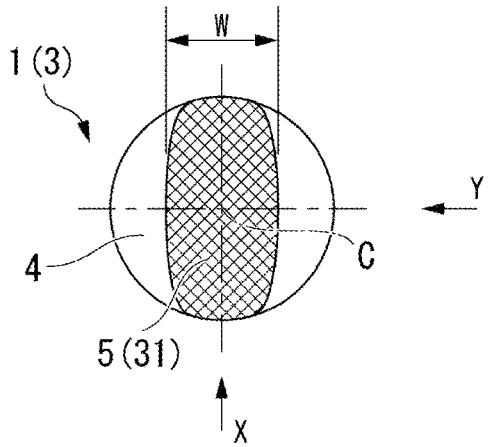
FIG. 34 is a front view of the fourth embodiment illustrated in FIG. 33 viewed from the distal end side of the tip main body.
Figure 35:
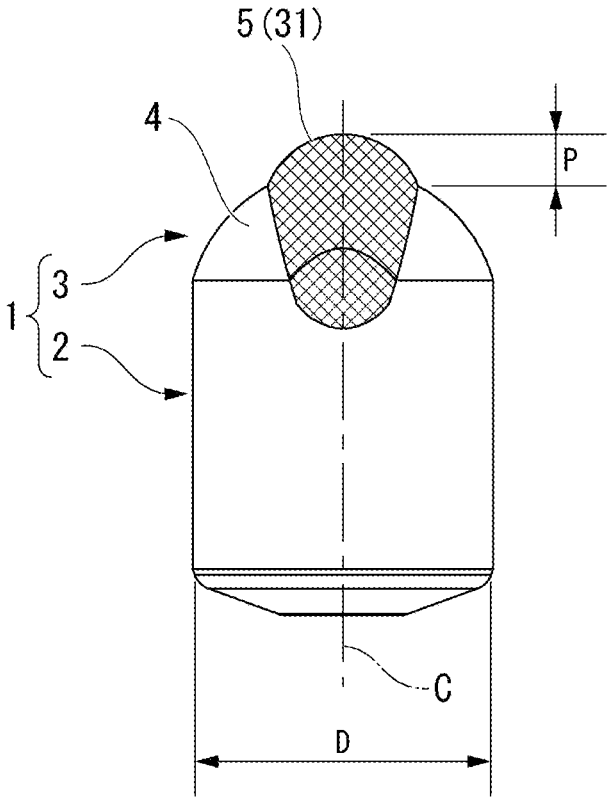
FIG. 35 is a side view viewed in the arrow X direction in FIG. 34.
Figure 36:
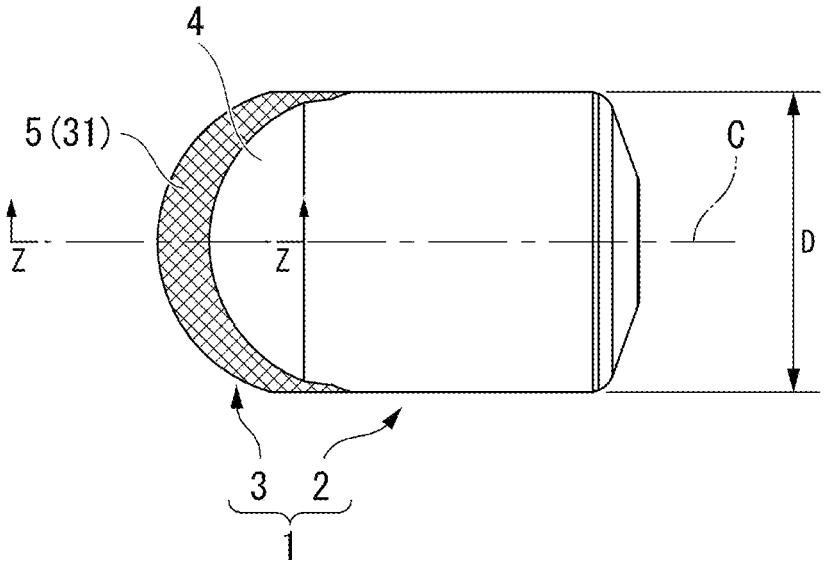
FIG. 36 is a side view viewed in the arrow Y direction in FIG. 34.
Figure 37:
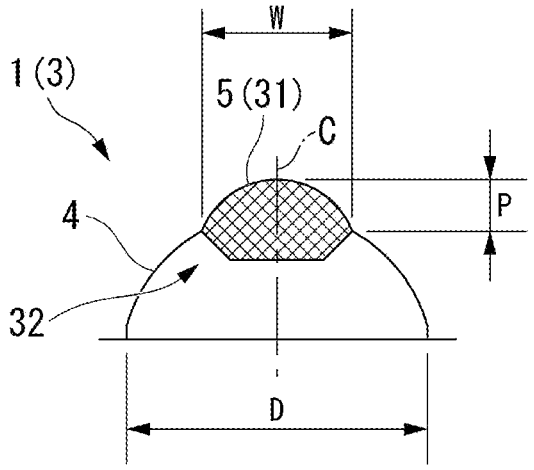
FIG. 37 is a ZZ cross-sectional view in FIG. 36.

Further, in the third and fourth embodiments, this projection portion 5 is formed of a polycrystalline diamond sintered body 31 (parts indicated by hatching in FIGS. 28 to 37) having a higher hardness than a hard metal alloy forming the tip main body 1. Here, in the third embodiment, only the projection portion 5 protruding from the surface of the curved convex surface-shaped portion 4 is formed of the polycrystalline diamond sintered body 31 as illustrated in FIG. 32. In contrast, in the fourth embodiment, a concave groove 32 such as a trapezoidal shape in a cross section is formed in the diameter direction in the curved convex surface-shaped portion 4 as illustrated in FIG. 37, and the polycrystalline diamond sintered body 31 is arranged in the concave groove 32 and the projection portion 5.

According to such drilling tips of the third and fourth embodiments, the projection portion 5 in which wear is limited to the distal end portion 3 of the tip main body 1 is formed of the polycrystalline diamond sintered body 31 having a higher hardness than a hard metal alloy used as a material of the tip main body 1. Therefore, wear of the tip main body 1 can be further curbed, and the service life of the tip main body 1 can be extended. For this reason, deterioration in boring efficiency of the drilling tool can be more reliably curbed.

In addition, in a drilling tip using a general polycrystalline diamond sintered body, the entire surface of the distal end portion of the tip main body formed of a hard metal alloy is coated with the polycrystalline diamond sintered body. However, in this case, depending on the thickness of a coated layer of the polycrystalline diamond sintered body, a large amount of polycrystalline diamond sintered body may be required. By comparison, according to the foregoing third and fourth embodiments, the used amount of the expensive polycrystalline diamond sintered body 31 can be reduced, which is economical.

Moreover, particularly in the fourth embodiment, when the projection portion 5 is form of a polycrystalline diamond sintered body 31 in this manner, the concave groove 32 is formed in the diameter direction in the curved convex surface-shaped portion 4 of the tip main body 1, and the polycrystalline diamond sintered body 31 is arranged in the concave groove 32 and the projection portion 5. For this reason, interfacial adhesion strength can be improved by securing a large bonded area between the polycrystalline diamond sintered body 31 and the distal end portion 3 of the tip main body 1 and enhancing retention strength of the polycrystalline diamond sintered body 31 by a wall surface of the concave groove 32. Therefore, it is possible to prevent a situation in which the projection portion 5 formed of a polycrystalline diamond sintered body 31 peels from the tip main body 1 due to the load at the time of boring.

In the third and fourth embodiments, similar to the second embodiment, the projection portion 5 is formed to protrude in a curved convex shape such as a convex arc when viewed in the diameter direction. However, similar to the first embodiment and the modification example of the first embodiment, the projection portion 5 may be formed to protrude from the curved convex surface-shaped portion 4 in an isosceles trapezoidal shape when viewed in the diameter direction. In addition, also in the third and fourth embodiments, it is desirable that the protrusion height P of the projection portion 5 from the curved convex surface-shaped portion 4 on the center line C of the tip main body 1 be within a range of 9/100 to 30/100 the diameter D of the base end portion 2 of the tip main body 1.

Figure 38:
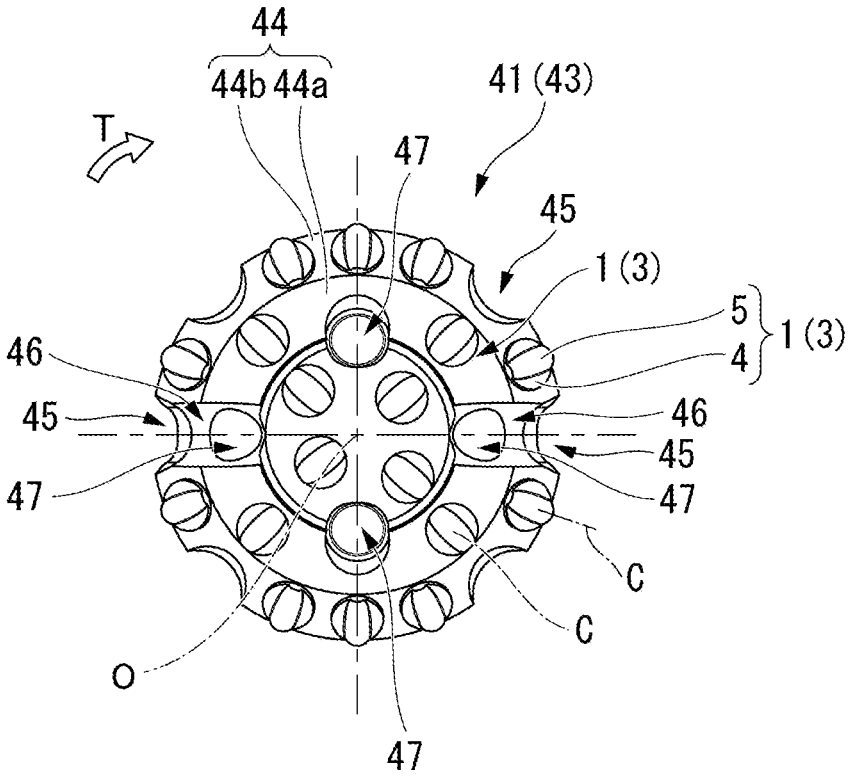
FIG. 38 is a front view of the third embodiment of the drilling tool of the present invention to which the drilling tip of the second embodiment illustrated in FIGS. 22 to 25 is attached.
Figure 39:
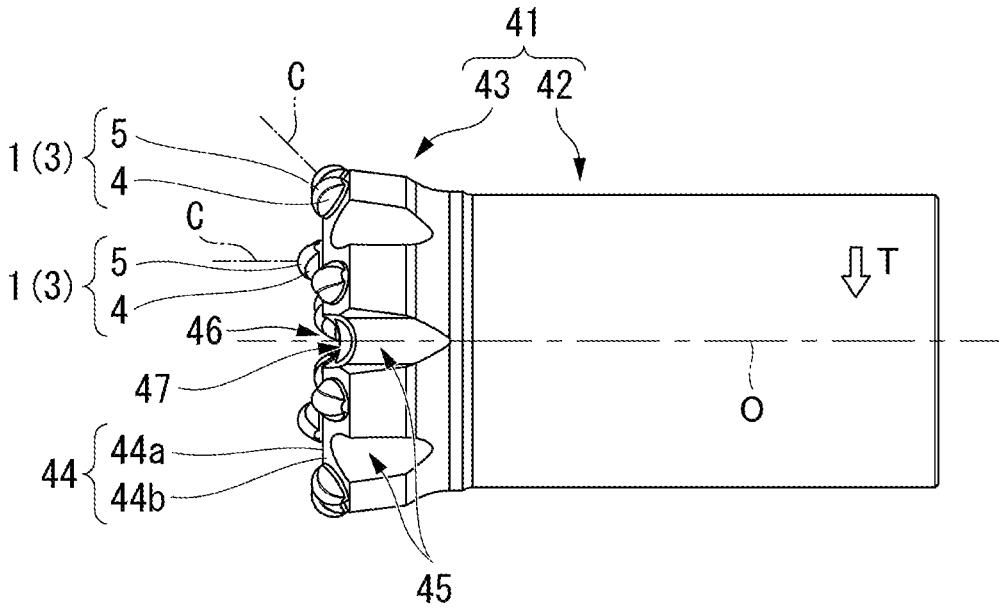
FIG. 39 is a side view of the third embodiment of the drilling tool of the present invention illustrated in FIG. 38.
Figure 40:
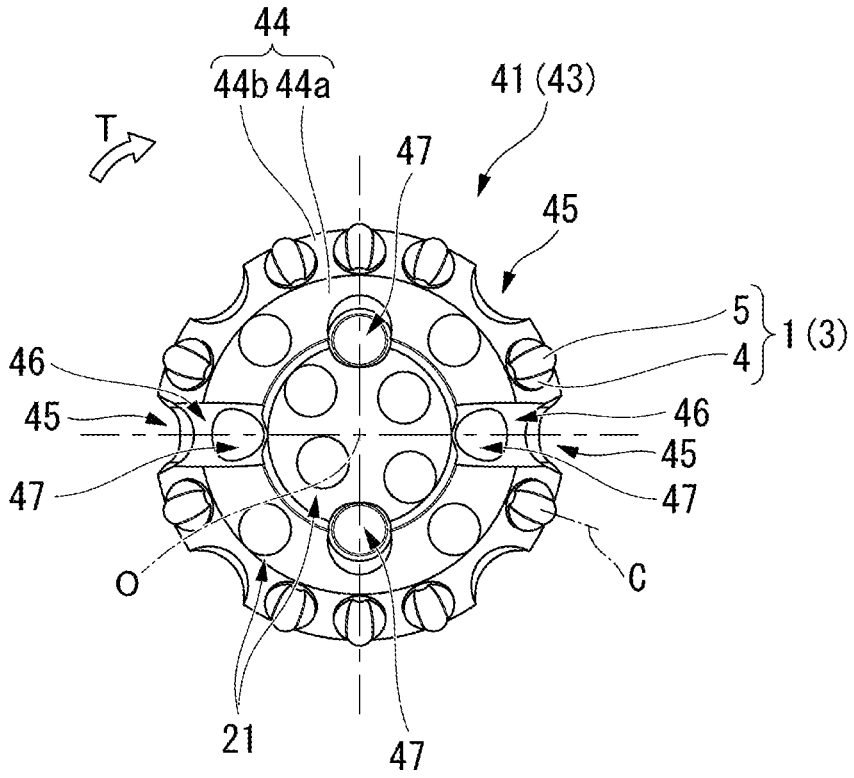
FIG. 40 is a front view of the fourth embodiment of the drilling tool of the present invention to which the drilling tip of the second embodiment illustrated in FIGS. 22 to 25 is attached.
Figure 41:
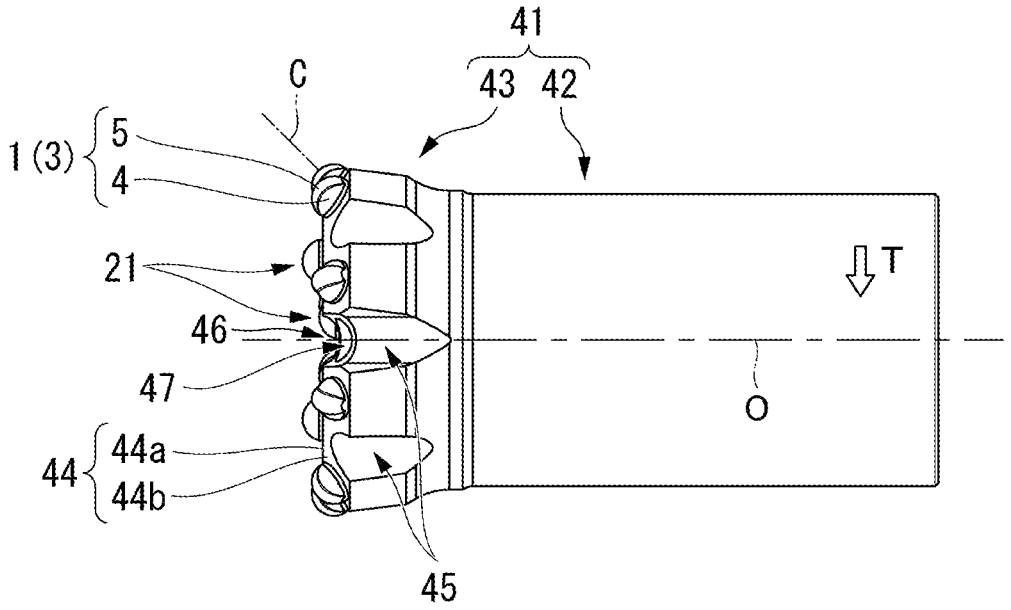
FIG. 41 is a side view of the fourth embodiment of the drilling tool of the present invention illustrated in FIG. 40.

Moreover, FIGS. 38 and 39 illustrate the third embodiment of the drilling tool of the present invention to which the drilling tip of the second embodiment illustrated in FIGS. 22 to 25 is attached. Similarly, FIGS. 40 and 41 illustrate the fourth embodiment of the drilling tool of the present invention to which the drilling tip of the second embodiment illustrated in FIGS. 22 to 25 is attached. In the drilling tool of the first embodiment illustrated in FIGS. 5 and 6 and the drilling tool of the second embodiment illustrated in FIGS. 26 and 27, the tool main body 11 is attached to a down-the-hole hammer. In contrast, in the drilling tools of the third and fourth embodiments, a tool main body 41 is attached to a top hammer.

In the third and fourth embodiments, the tool main body 41 is formed to have substantially a bottomed cylindrical shape centering on the axis O, and a cylinder portion of the tool main body 41 serves as a skirt portion 42, a bottomed portion serves as a head portion 43 having a larger outer diameter than the skirt portion 42, and this head portion 43 faces the distal end side in the direction of the axis O. In this manner, a distal end surface 44 of the head portion 43 facing the distal end side includes a face surface 44*a* facing the distal end side of the tool main body 41 at the central portion around the axis O, and the outer circumference of this face surface 44*a* includes a gauge surface 44*b* extending to the rear end side as it goes toward the outer circumferential side of the tool main body 41.

In addition, a plurality of (six in the present embodiment) cuttings discharge grooves 45 extending parallel to the axis O are formed on the outer circumferential surface of the head portion 43 at intervals in a circumferential direction, and two groove portions 46 are formed on the distal end surface 44 of the head portion 43 from distal ends of two discharge grooves 45 positioned on sides opposite to each other with respect to the axis O such that they extend toward the inner circumferential side in a radius direction with respect to the axis O.

Moreover, a plurality of (four in the present embodiment) blow holes 47 branching such that they extend toward the outer circumferential side as it goes toward the distal end side are formed at equal intervals in the circumferential direction and open on the distal end surface 44 from the central portion on the bottom surface facing the rear end side of the skirt portion 42. Two blow holes 47 positioned on sides opposite to each other with respect to the axis O open on two groove portions 46.

Meanwhile, a female screw portion (not illustrated) is formed on the inner circumferential surface of the skirt portion 42, and a male screw portion of a drilling rod (also not illustrated) is screwed into this female screw portion. The drilling tools of the third and fourth embodiments perform boring using the drilling tip attached to the distal end surface 44 by means of a striking force applied from a top hammer to the distal end side in the direction of the axis O via this drilling rod and a rotation force in the tool rotation direction T around the axis O.

Here, in the drilling tool of the third embodiment illustrated in FIGS. 38 and 39, similar to the drilling tool of the first embodiment, the drilling tip attached to both the face surface 44*a* and the gauge surface 44*b* of the distal end surface 44 serves as the drilling tip of the second embodiment illustrated in FIGS. 22 to 25.

In contrast, in the drilling tool of the fourth embodiment illustrated in FIGS. 40 and 41, similar to the drilling tool of the second embodiment, the drilling tip attached to the gauge surface 44*b* of the face surface 44*a* and the gauge surface 44*b* of the distal end surface 44 serves as the drilling tip of the second embodiment, and the drilling tip attached to the face surface 44*a* serves as a button tip.

Also in such drilling tools of the third and fourth embodiments, the drilling tip of the second embodiment is attached to the distal end surface 44 of the tool main body 41. Therefore, wear-width progression of the distal end portion of the tip main body 1 of this drilling tip can be curbed, and deterioration in boring efficiency of the drilling tool can be curbed. In addition, even when repolishing is performed for a drilling tip, the projection portion 5 need only be repolished. Thus, costs incurred for repolishing can be reduced, and efficient and economical boring can be performed.

In addition, particularly, in the drilling tool of the fourth embodiment, the drilling tip attached to the gauge surface 44*b* serves as the drilling tip of the second embodiment, and the drilling tip attached to the face surface 44*a* serves as a general button tip. Therefore, the balance between the service lives of the drilling tip attached to the face surface 44*a* and the drilling tip attached to the gauge surface 44*b* can be achieved.

INDUSTRIAL APPLICABILITY

As described above, according to a drilling tip and a drilling tool of the present invention, deterioration in boring efficiency can be curbed and costs of repolishing can be reduced by curbing wear-width progression of a distal end portion of a tip main body of a drilling tip attached to a distal end surface of a tool main body of the drilling tool.

REFERENCE SIGNS LIST

1 Tip main body
2 Base end portion
3 Distal end portion
4 Curved convex surface-shaped portion
5 Projection portion
5*a* Inclined surface of projection portion 5
5*b* Apex surface of projection portion 5
11, 22, 41 Tool main body
12, 44 Distal end surface of tool main body 11 or 41
12*a*, 44*a* Face surface
12*b*, 44*b* Gauge surface
13 Shank portion
14, 43 Head portion
15, 45 Discharge groove
16, 47 Blow hole
17, 46 Groove portion
21 Tip main body of button tip
31 Polycrystalline diamond sintered body
32 Concave groove
42 Skirt portion
C Center line of base end portion 2 of tip main body 1
D Diameter of base end portion 2
W Largest width of projection portion 5 in direction perpendicular to diameter direction in which projection portion 5 extends when viewed from distal end side of tip main body 1 in direction of the center line C
P Protrusion height of projection portion 5 from curved convex surface-shaped portion 4 on center line C
O Axis of tool main body 11
T Tool rotation direction

What is claimed is:

1. A drilling tip that is attached to a distal end surface of a tool main body of a drilling tool which is rotated around an axis and in which a striking force is applied to a distal end side in a direction of the axis, the drilling tip comprising:

a tip main body in which a base end portion having a columnar shape and a distal end portion protruding from the base end portion to the distal end side are integrally formed, wherein the distal end portion includes, a curved convex surface-shaped portion protruding to the distal end side of the tip main body, and a projection portion extending in a first diametrical direction with respect to a center line of the base end portion viewed from the distal end side of the tip main body and further protruding to the distal end side from a surface of the curved convex surface-shaped portion, and wherein a largest width of the projection portion in a second diametrical direction perpendicular to the first diametrical direction viewed from the distal end side of the tip main body in a direction of the center line is within a range of ⅓ to ½ a diameter of the base end portion.

2. The drilling tip according to claim 1, wherein a protrusion height of the projection portion from the curved convex surface-shaped portion gradually increases from both end portions of the projection portion in the first diametrical direction toward a central portion positioned on the center line.

3. The drilling tip according to claim 1, wherein a largest width of the projection portion in a direction perpendicular to the first diametrical direction viewed from the distal end side of the tip main body gradually increases from both end portions of the projection portion in the first diametrical direction toward the central portion positioned on the center line.

4. The drilling tip according to claim 1, wherein a width of the projection portion in a direction perpendicular to the first diametrical direction gradually increases toward the base end portion side.

5. The drilling tip according to claim 4, wherein the projection portion is formed to protrude in a curved convex shape when viewed in the first diametrical direction.

6. The drilling tip according to claim 1, wherein both end portions of the projection portion of the projection portion in the first diametrical direction are positioned in a boundary portion between the base end portion and the distal end portion of the tip main body.

7. The drilling tip according to claim 1, wherein the curved convex surface-shaped portion has a hemispherical shape centering on the center line.

8. The drilling tip according to claim 1, wherein the projection portion is formed of a polycrystalline diamond sintered body.

9. The drilling tip according to claim 8, wherein a concave groove is formed in the first diametrical direction in the curved protrusion surface-shaped portion, and wherein the polycrystalline diamond sintered body is arranged in the concave groove and the projection portion.

10. A drilling tool, wherein the drilling tip according to claim 1 is attached to a distal end surface of a tool main body which is rotated around an axis and in which a striking force is applied to a distal end side in a direction of the axis such that the distal end portion protrudes and the projection portion extends in a radial direction with respect to the axis when viewed from the distal end side of the tool main body.

11. The drilling tool according to claim 10, wherein the distal end surface of the tool main body includes a face surface facing the distal end side of the tool main body at a central portion around the axis, an outer circumference of the face surface includes a gauge surface extending to a rear end side toward an outer circumferential side of the tool main body, and the drilling tip is attached to both the face surface and the gauge surface.

12. The drilling tool according to claim 10, wherein the distal end surface of the tool main body includes a face surface facing the distal end side of the tool main body at a central portion around the axis, an outer circumference of the face surface includes a gauge surface extending to a rear end side toward an outer circumferential side of the tool main body, and the drilling tip is attached to only the gauge surface.

13. A drilling tip that is attached to a distal end surface of a tool main body of a drilling tool which is rotated around an axis and in which a striking force is applied to a distal end side in a direction of the axis, the drilling tip comprising:

a tip main body in which a base end portion having a columnar shape and a distal end portion protruding from the base end portion to the distal end side are integrally formed, wherein the distal end portion includes, a curved convex surface-shaped portion protruding to the distal end side of the tip main body, and a projection portion extending in a first diametrical direction with respect to a center line of the base end portion viewed from the distal end side of the tip main body and further protruding to the distal end side from a surface of the curved convex surface-shaped portion, wherein a width of the projection portion in a direction perpendicular to the first diametrical direction gradually increases toward the base end portion side, and wherein the projection portion is formed to protrude in an isosceles trapezoidal shape when viewed in the first diametrical direction.

14. A drilling tip that is attached to a distal end surface of a tool main body of a drilling tool which is rotated around an axis and in which a striking force is applied to a distal end side in a direction of the axis, the drilling tip comprising:

a tip main body in which a base end portion having a columnar shape and a distal end portion protruding from the base end portion to the distal end side are integrally formed, wherein the distal end portion includes, a curved convex surface-shaped portion protruding to the distal end side of the tip main body, and a projection portion extending in a first diametrical direction with respect to a center line of the base end portion viewed from the distal end side of the tip main body and further protruding to the distal end side from a surface of the curved convex surface-shaped portion, and, wherein a protrusion height of the projection portion from the curved convex surface-shaped portion on the center line is within a range of 9/100 to 30/100 the diameter of the base end portion.

* * * * *